United States Patent [19]

Bridgeman et al.

[11] Patent Number: 5,046,736

[45] Date of Patent: Sep. 10, 1991

[54] IMITATIVE-OPPONENT GAMBLING GAMES

[76] Inventors: James L. Bridgeman; Nancy L. Bridgeman; Robert J. Bridgeman, all of 9582 Hamilton Ave., Huntington Beach, Calif. 92646

[21] Appl. No.: 255,656

[22] Filed: Oct. 11, 1988

[51] Int. Cl.[5] ..... A63F 7/06

[52] U.S. Cl. ..... 273/85 G; 273/85 CP; 273/DIG. 28; 273/243

[58] Field of Search ..... 273/85 CP, 85 G, 1 E, 273/238, 128 A, 243, 293; 434/128, 129

[56] References Cited

U.S. PATENT DOCUMENTS

| | | | |
|---|---|---|---|
| 1,461,633 | 7/1923 | Stansbury | 273/293 |
| 2,223,175 | 11/1940 | Ink | 273/243 |
| 3,033,572 | 5/1962 | Thibault | 273/243 |
| 4,380,334 | 4/1983 | Minkoff et al. | 273/85 CP |
| 4,614,342 | 9/1886 | Takashima | 273/85 CP |
| 4,657,256 | 4/1987 | Okada | 273/138 A |
| 4,679,143 | 6/1987 | Hagiwara | 273/138 A |
| 4,760,527 | 7/1988 | Sidley | 273/85 CP |
| 4,799,683 | 1/1989 | Brunes | 273/85 CP |
| 4,838,552 | 6/1989 | Hagiwara | 273/138 A |

*Primary Examiner*—Edward M. Coven
*Assistant Examiner*—Dean Small

[57] ABSTRACT

A gambling game which combines the rudiments of poker with imitative opponents (FIG. 3) leading to the creation of new video poker games (FIGS. 4 and 5). Opponents are simulated to imitate each action of the player (FIGS. 3 and 4) so that when the player bets, each opponent matches the bet; when the player folds, the opponents fold. The video poker games are played on a game device including a video screen (FIG. 1A). There are multiple computer opponents (FIG. 5) with one or more bets (FIGS. 4 and 6). Displays show cards being dealt (FIG. 4) with the pot increasing for each bet (FIGS. 4 and 7). Summary hand information (FIG. 11) is displayed and automatic advancement of the ante (FIG. 6) and the bet (FIG. 7) speeds up play. The winner is visually announced after each round (FIGS. 4 and 5). The housetake is determined (FIG. 14), a payoff is calculated (FIG. 15), and the winnings are distributed (FIG. 16). The player has a choice of different games, modes, options, number of opponents, amounts of but, housetakes, jokers, and wild cards (FIG. 5). A reliable payoff (FIGS. 14 and 15) is insured with "Cruise Control" (FIG. 8) utilizing a fold table to simulate realistic play which helps to determine the appropriate housetake. A variable housetake feature (FIG. 14) calculates and changes the housetake according to the first cards dealt to the player, resulting in a poker game called Percentage Poker (FIG. 17).

15 Claims, 21 Drawing Sheets

| |
|---|
| NUMBER OF JOKERS |
| CARDS SELECTED TO BE WILD |
| TYPE OF GAME |
| TYPE OF MODE |
| TYPE OF OPTION |
| HOUSETAKE |
| NUMBER OF PLAYERS |
| COINS |
| SET-ANTE & SET-BET |
| CREDITS AVAILABLE |
| ANTE & BET |
| SUMMARY HAND INFORMATION |
| AMOUNT OF POT |
| AREA FOR SETTING PATTERNS |
| STATISTICS |
| AMOUNT OF BET |
| FOLD TABLES |
| CRUISE CONTROL TABLES |
| VARIABLE PAYOFF FACTORS |
| JACKPOT PARAMETERS |
| EXCLUSIVE OR ROUTINES |
| STEPS OF THE PROGRAM |
| NUMBER OF OPPONENTS |
| CARD DECKS |
| WINNER PAYOFF TABLES |
| LOSER PAYOFF TABLES |
| ACTIVE MACHINES ON LINE |
| NUMBER OF HUMAN OPPONENTS |
| NUMBER OF COMPUTER OPPONENTS |
| |
| |
| |

FIG. 2B

IMITATIVE-OPPONENT GAMBLING GAMES

BACKGROUND

1. Field Of Invention

This invention relates to games of chance, particularly to electronically-simulated poker and similar games, playable on electronic game machines or as board games.

2. Description Of Prior Art

Poker is a well-known game dating back to the German game "poken" or "bluff" in the 1600s. According to "Hoyle's Rules of Games" by Morehead and Smith, 1983, poker players can bluff, bet, raise, call, check or fold.

The designers of video poker game machines have tried faithfully to duplicate all of the above actions, causing such machines to be complex and slow playing. Multiple opponents and multiple bets have not been sucessfully adapted to the casino environment. The number of variables is unmanageable when multiple opponents can bet, check, raise, bluff, and fold. As a result, it is almost impossible to determine the casino's profit in advance. Thus casinos were not interested in purchasing such machines.

Currently, casinos have a five-card-draw poker machine which is playable by only one person with no opponents. It has been around for over ten years and has hardly changed. It has no variety, and barely resembles poker since it doesn't provide opponents. The gambling industry has not found a new video poker game justifying the risk and investment it takes to bring it to the public.

OBJECTS AND ADVANTAGES

Accordingly we have provided a video poker game with the following objects and advantages. Our video poker game provides all of the essential actions and plays of manual poker games, but is relatively simple and fast playing. In our game the player initiates all actions, but opponents are simulated to respond by imitating each action of the player. There is challenging variety, while being quick and simple to play, but with a reliable payoff system.

Also, our game can handle multiple opponents with one or more bets which can build up a large pot. Variety is provided with a wide choice of games, modes and options, with any number of wild cards and jokers, while allowing the player to choose a hand from many hand positions. Our game provides player aids which enable a player to make a quick evaluation of all the hands from summary hand information, leading to fast play.

Automatic advancing of the bet is provided to speed up the game. The next ante or bet (equal to the last ante or bet) is automatically advanced from credits, if available. Casinos now require the player to push a button each time credits are used.

Reliable payoffs are determined by using an automatic poker player called cruise control. It simulates thousands of games with or without a video display, while allowing human intervention. Cruise control utilizes fold tables that can mimic the most experienced gambler. This enables the casino to simulate the actions of a player to determine the appropriate housetakes and payoffs. The operator at the computer console chooses the selections to be simulated while statistics are gathered. These statistics allow a reliable payoff to be derived.

A variable housetake is provided to counteract the player advantages so that a large housetake won't be required every time. The variable housetake is computed from pre-assigned weights for the player's cards and is changed each round. The payoff percentage which is a function of the housetake is displayed on the video screen to provide an extra challenge to the player. This creates a new game called percentage poker.

A variety of exciting and different payoffs are provided. A round payoff is modified by using several bonus tables: winner bonus, loser bonus, fold bonus, and a jackpot bonus.

Several video screens controlled by a central processor can be hooked together, allowing several lead players to play the same game at the same time. Each display device is associated with one of the displayed hands selected by the human player. Using percentage poker concepts, each hand is given a different payoff percentage. With all the display devices grouped together, this creates another level of interest because players can compare hands and payoffs.

The generality of the imitative-opponent method was tested by a board game using poker rules. There are no other board games where poker hands affect the movement of a marker around a board, and where the combined winnings from poker winnings and a second pot determine the winner of the game. The board game has playing cards in spaces on the board which are used as part of the participant's hand. The board game is a poker learning device with the odds for making certain hands printed on the board. Although originally developed for imitative-opponent games, the board game is suitable for normal poker games as well.

The imitative-opponent method is supported by the described features, namely: cruise control, fold table, variable housetake, percentage poker, jackpot bonus round, summary hand information, automatic ante and bet advances, and bonus tables.

Readers will find further objects and advantages of the invention from a consideration of the ensuing description and the accompanying drawings.

DEFINITIONS

We have coined words and terms to adequately describe the games, the operation of the games, and a game-support system. In addition to our new words and terms, the following list of definitions includes words in the gambling industry that may not be widely known, and known words with a narrow meaning as applied to our invention.

Bug. A joker that is wild only for filling straights or flushes or to represent an Ace, whichever creates the best hand.

Cancel. A button, which, when activated by a player, cancels the last ante or bet and moves any ante or any bet into credits.

Card. A game symbol having a face which contains a suit value and a number value, and a back which is plain or non-descriptive with no value in the play of the game.

Card order. A ranking of cards relative to each other.

Check. A zero bet.

Collect. A button, which, when activated by a player, transfers and pays credits to a player.

Credits. A delayed payout held by house for benefit of player.

Cruise Control Table. A table used in the operation of the cruise control program and includes variables for determining scope of multiple runs of game, including ante and bet values, housetake, and whether cards are to be visually displayed or not.

Cruise Control. A program which automatically plays a specified number of rounds by simulating player actions with or without display of game symbols, while allowing for user intervention.

Discard Table. A table used for determining what cards are to be discarded by an opponent. Each selection is organized by a hand value range from top to bottom with the top having the highest hand value range. Each range entry includes low hand value, high hand value, number of discards to be made, and whether to go for inside straights, outside straights, and whether to go for straight or flush if both are possible, and any other pertinent choices. E.g. an entry could specify to break up pair and go for the straight if there is one pair with a possible straight.

Draw percentage poker. A new game using any discard poker game rules and the variable housetake concept where the payoff percentage is displayed on the screen which the player must take into account during play to decide whether the odds justify continued play.

End Space. A space that is the same as a starting space except that the board game ends when participant marker lands on it.

Faceup. A method of dealing/displaying the cards with the faces always showing, with the suits and number values always visible.

Fastdraw. A game in which all cards are dealt faceup to all participants after only one bet, thereby having a slot machine effect. A hand with only one bet and one deal.

Fixed housetake. An unchanging percentage of a pot, etc. or amount of money the house keeps at the end of each round. See housetake.

Fixed housetake table. A table that specifies a fixed housetake for each possible selection.

Flop. The exposed community cards which are used by all participants as part of their hands.

Fold. An action taken by a player in which he or she drops out of a round thus causing the end of the round. The remainder of the cards for the hand are dealt faceup as though the game round had normally been played through to completion.

Fold Bonus Table. A table which specifies a limited bonus to be paid to a folding player if the folded hand was a very good hand such as a royal flush.

Fold Table. A table which defines combinations of cards at each bet stage that causes the player to automatically fold. It is normally used by cruise control.

Fold Pot. An amount paid to a player who folds with a winning hand.

Game. A poker card game suitable to adapt to imitative opponents.

Game Action. An action taken by player which opponents imitate such as bet, deal, fold, check, cancel, discard, etc.

Game Device. A device which may be a board game, home computer, video game machine, gambling poker machine, etc.

Game Symbols. A visual aid for value representations, cards, etc.

Hand. The playing cards held by a participant.

Hand position. A Player's or an opponent's card hand location on the screen.

Hand Order. A ranking of card hand types relative to each other.

Hand points. (Board Game). A method to determine the amount of spaces to move a marker based on the hand type, hand rank, or other hand value.

Hand points. (General). An amount of points assigned to a hand. After accumulating a certain amount, a jackpot is awarded.

Hand rank. A hand value for a given card hand.

Hand type. See hand type for high hand and hand type for low hand.

Hand Type For High Hand. A classification of hands into pairs, trips, full house, four of a kind, straights, flushes, straight flushes, royal flushes, five of a kind, and the like.

Hand Type For Low Hand. A classification of a hands into a bicycle or wheel (Ace, 2, 3, 4, 5), 6-4, 6-5, and the like.

Hand Value. A card order within a hand order causing one hand to be better than another with the same hand type, e.g. an Ace-high straight is better than a 10-high straight.

Handweight. A total value of the cards in a hand. Weights are assigned to various card orders. The combinations of some cards in a hand are used to obtain a total handweight value.

Hiball. A variety of poker games in which the best high hand wins.

Hilo. A form of poker in which the best high hand and the best low hand normally split the pot.

Hold'Em poker. A game identified by having a flop which all participants use as part of their held hands.

House. The banker and the sponser of a poker game, including a casino, betting parlor, cocktail lounge, video owner or lessee, so-called banker participant, and the like.

Housetake. An amount of money the house keeps at the end of each round: a fixed amount (often called a rake), a percentage of the pot, a fixed housetake, a variable housetake, a percentage of player bet, a percentage of opponent bet, a percentage of total bet, etc. This amount is determined by the house or other controlling agency.

Housetake Tables. A table which specifies a housetake for each combination of possible selection.

Imitative-opponent. An opponent in a game that follows the leader by imitating him or her. The opponent imitates each game action of a player, including a discard game, where an opponent intelligently discards.

Interchange. A vehicle which allows the player to become a user and vice versa.

Instruction activator(s). A device (mechanical or electronic, keys, etc.) that is coupled to a control circuit to allow a user or player to take an action such as deal, bet, fold, acceptance of coins or tokens, payout of coins or tokens (on demand or automatically), and the like.

Jackpot Round. A round in which a player has the chance to win the jackpot.

Jackpot for video game. A special bonus paid by the house after a certain number of hands if player is a round winner in a jackpot round.

Jackpot Bonus Table. A table used for a video game. It provides variables to determine when to award jackpot bonus. It also has a jackpot amount, jackpot factor, jackpot range number, and a base eligibility number of rounds which is modified by a randomized jackpot range number.

Loball. A variety of poker games in which the best low hand wins.

Loser payoff factor. A percentage to modify the round winnings, pot, total bet, or the like which is paid to the losing player who has a certain hand rank.

Loser payoff table. A table of hand rank entries including: hand type, lowest hand rank for hand type, highest hand rank for hand type, minimum payoff amount, a maximum payoff amount, loser payoff factor, and loser payoff amount. A group of these entries is established for each possible selection.

Marker Card. A stationary card design within a space on a board game which is used as part of a card hand.

Mode. A particular variety of poker indicating what type of hand will win. It includes hiball, loball, hilo and the like.

Option. A card dealing scheme called: faceup, fastdraw, standard and the like.

Payoff Percentage. A percentage displayed during percentage poker games in which the payoff percentages is fixed, or changes dynamically based on a player's cards.

Penalty Space. A location on the game board where the player must go backward, lose a turn, etc. after landing on it.

Percentage Draw Poker. See Draw Percentage Poker.

Percentage Poker. A game invented using any poker game rules and the variable housetake concept which displays a payoff percentage on the screen. The player plays the percentages since it changes the odds and the potential winnings for a given hand value.

Ranking order. The winning order of a card hand relative to each card hand as defined by a set of playing rules.

Ranking value. The number assigned to each hand where the higher the ranking, the better the hand.

Round. The time between the start and the end of one part of a game, normally between the Ante and the distribution of the round winnings.

Round Winnings. An amount paid to a winner of the round. It is normally the pot less the housetake.

Second Pot For Board Game. A retained housetake (or accumulated antes or bets) which is distributed at the end of the game to the successful participant who lands first on an end space.

Second Pot Winner (Board Game). The first participant to land on an end space is the second pot winner.

Selection. A choice from available games, modes, options, number of opponents, housetake, wild cards, jokers, etc.

Set-ante. An ante established by the player to be automatically advanced if the player has sufficient credits.

Set-bet. A bet established by the player to be automatically advanced if the player has sufficient credits.

Standard. The playing card rules where some or all of the cards are dealt facedown.

Stud poker. A poker game in which some cards are dealt faceup.

Suicide Poker. Same as Fastdraw.

Summary hand information. A method of displaying the hand rank of each participant's card hand with printed messages on or near card hands immediately after each set of cards are dealt.

Switching. A vehicle to allow the player to become an opponent, and vice versa.

User. A user is a person that may or may not be the player. The user sets up, manages and controls the operations of the game, while the player only plays the game.

User Action. An action a user takes, such as the setup of fold tables, setup of cruise tables, making game selections, etc.

Variable Housetake. A housetake based on a system whereby a value is placed on the players hand by assigning weights to some or all cards of the player. It is translated into a payoff percentage in a percentage poker game.

Variable Housetake Table. A table that specifies an assigned weight for each of the cards of a card order, or combinations of card orders for each possible selection. It also specifies the number (how many) of the first dealt cards to which weights are to be assigned to compute a handweight.

Winner Bonus Amount. An amount paid in addition to the round winnings to the round winner who has one of a selection of hand ranks.

Winner Bonus Factor. A percentage of the round winnings, pot, total bet, or the like which is paid in addition to the round winnings to the round winner who has a certain hand rank.

Winner Bonus Table. A table with hand rank entries including: hand type, lowest hand rank for hand type, highest hand rank for hand type, minimum payoff amount, a maximum payoff amount, winner payoff factor, and winner payoff amount. A group of these entries is established for each possible selection.

Winnings. The winnings are calculated by taking the pot less the housetake amount, and by adjusting for various bonus payoffs.

Winning Hand Information. Information that identifies and displays indication of best hand.

DRAWING FIGURES

FIG. 2B shows a memory allocation for a storage and retrieval area used by our imitative-opponent video poker game.

DRAWING REFERENCE NUMERALS

Figure 1A:
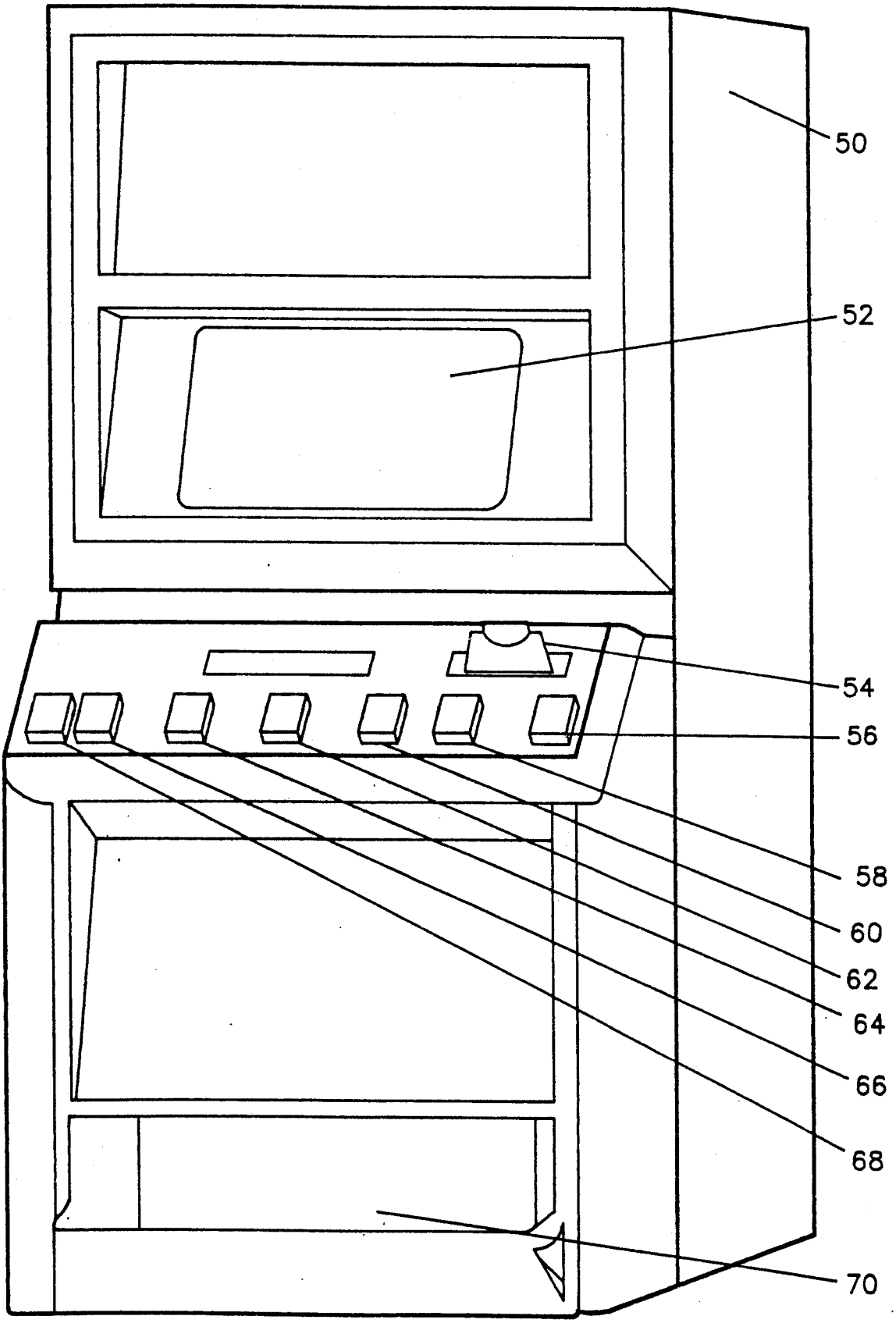
FIG. 1A is a perspective view of an electronic video poker game machine according to the present invention.

50 cabinet of video poker game machine
52 CRT
54 coin/credit inlet
56 fold button
58 deal button
60 bet button
62 select button
64 replay button
66 collect button
68 cancel button
70 coin/credit outlet
72 fold button for draw poker
74 deal button for draw poker
76 bet button for draw poker
78 draw and discard button
80 select/replay button
82 collect/cancel button
100 central processing unit
102 read only memory
104 random access memory
106 cathode ray tube controller
108 refresh memory of 100
110 read only memory of 106
112 video circuit
114 cathode ray tube
116 oscillation circuit
118 input/output port for 136, 138
120 input/output port for 140
122 input/output port for 142
124 buffer for 136
126 drive circuit for 136, 138
128 buffer for 140
130 drive circuit for 140
132 buffer for 142
134 drive circuit for 142
136 key activators
138 sound generator
140 coin or credit
142 disk drive
150 multiple electronic hookup

Detailed Description—FIG. 1A

FIG. 1A shows a perspective view of a video poker game machine according to the preferred embodiment of our invention. This machine can be used for the display and play of our imitative-opponent poker game.

The machine is based in a cabinet which is approximately 100 cm high, 45 cm wide, and 45 cm deep. It includes a cathode ray tube 52 and display panel hardware.

The player inserts a coin in a coin/credit inlet 54 to play an imitative-opponent poker game. The coin inlet is connected to an internal coin hopper (not shown) which is in turn connected to a coin/credit outlet 70; the hopper stores the coins until the payoffs are dispersed to the winners of the game.

After the player inserts the proper coins, a bet button 60 is pushed. The cards are dealt after the player pushes a deal button 58. While playing the game, if the player doesn't like his or her hand and wishes to fold, he or she pushes a fold button 56.

If a player wants to make a new selection and change the parameters of a poker video game, a select button 62 is pushed.

If the user wants to replay a particular video poker game, a replay button 64 can be pushed.

A collect button 66 is pushed when a player wants to collect his or her credits or winnings.

To cancel any of the above actions, a cancel button 68 is pushed.

All of the present buttons or keys are for playing a game and are located on the front surface of cabinet 50. These keys can be replaced by other types of controllers, such as a mouse, a computer keyboard, a joystick, a touchscreen, a light pen, or similar apparatus.

Figure 1B:
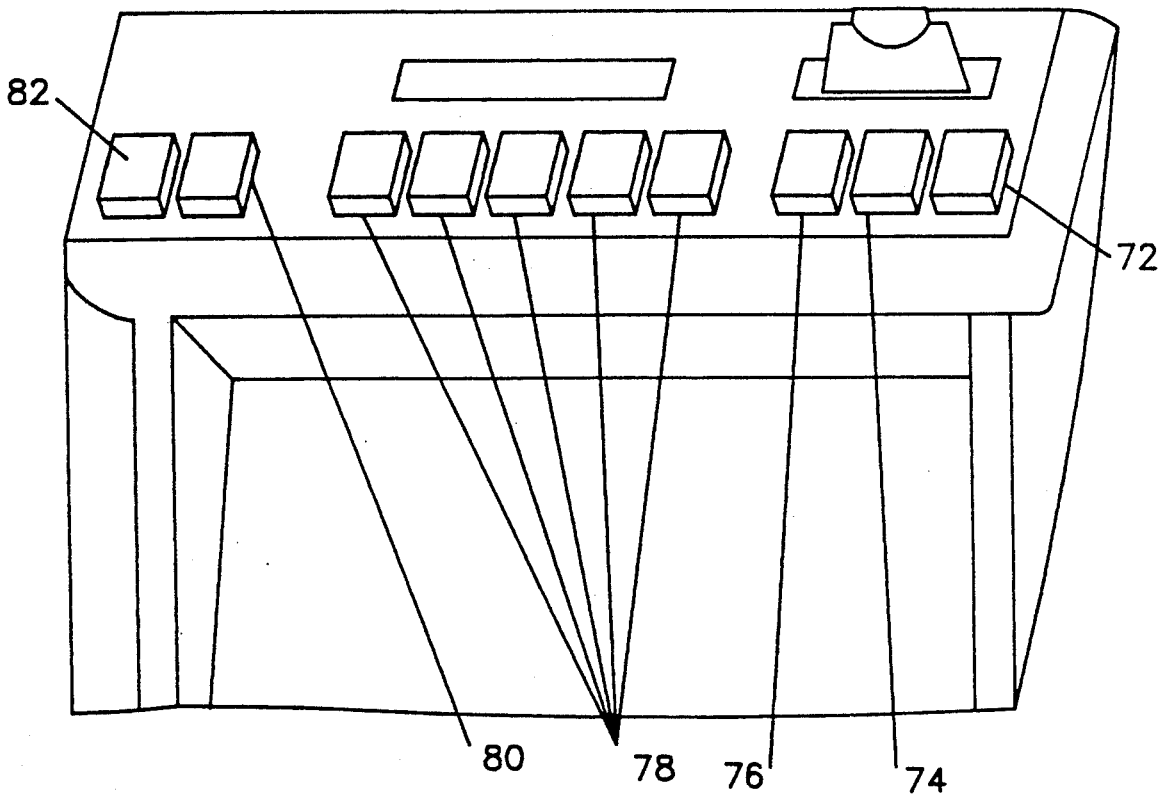
FIG. 1B is a close-up view of a keyboard for draw poker games using the same electronic video poker game machine system in FIG. 1A.

Detailed Description—FIG. 1B

FIG. 1B is a view of an alternative keyboard for a video draw poker game machine. It uses the same video poker machine as FIG. 1A with the exception of the keyboard which must accomodate draw and discard buttons.

The machine includes a fold button 72 which is pushed by a player if he or she wants to fold.

A deal button 74 is pushed to deal the cards. To bet, a player pushes a bet button 76. If the cards are not to the player's liking, he or she folds by pushing fold button 72. To discard unwanted cards and draw new cards to replace them, draw and discard button 78 are pushed.

If a player wants to make a new selection of a draw poker video game or if a user wants to replay a draw poker video game, a select/replay button 80 is pushed.

The collect/cancel button 82 is a dual function button, used only if a player wants to collect credits or winnings or wants to cancel any of the above actions in a video draw poker game.

Figure 1C:
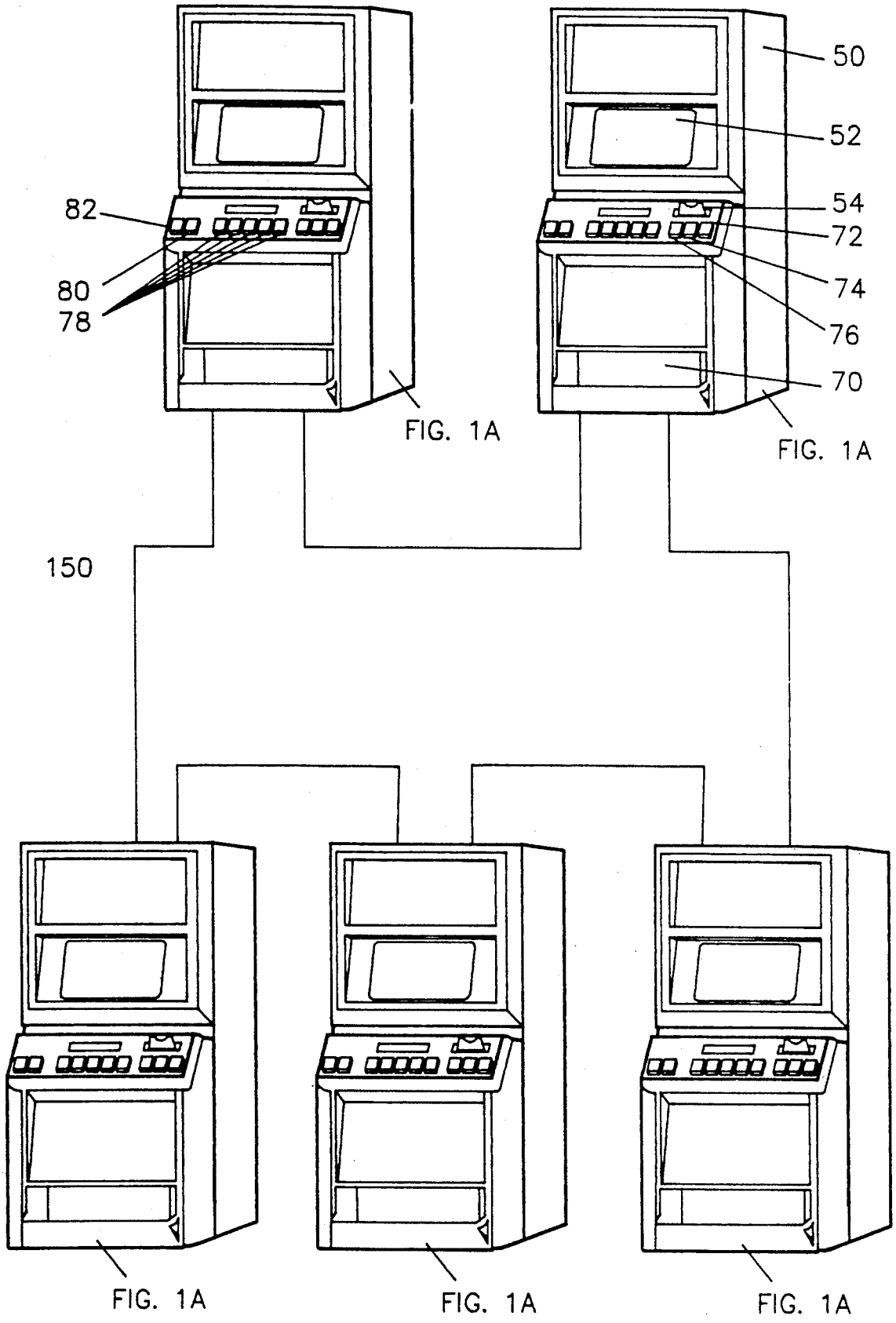
FIG. 1C is a perspective view of multiple display screens presented by the machine of FIG. 1A using the keyboard of FIG. 1B.

Detailed Description—FIG. 1C

FIG. 1C shows multiple video poker game machines similar to FIGS. 1A and 1B; these are electronically tied together by a hookup 150 to allow several players to play the same game. The multiple video poker game machines are controlled by a central processing unit in one of the machines. If one of the display devices is not occupied by a human player, then imitative computer opponents can fill in; the player does not have to wait until all display devices are occupied.

Each multiple display device has a cabinet 50 with a CRT video display, 52 a separate set of instruction keys 72-82, the same as in FIG. 1B, a coin/credit inlet 54, and payout mechanisms consisting of a coin/credit outlet 70 as shown in FIG. 1A. The same displays appear on all display devices, except that the betting information and hand position are different.

If a variable housetake is used, then the poker game played becomes a percentage poker game and the winning payoffs would be different for each player position on the screen.

Figure 10:
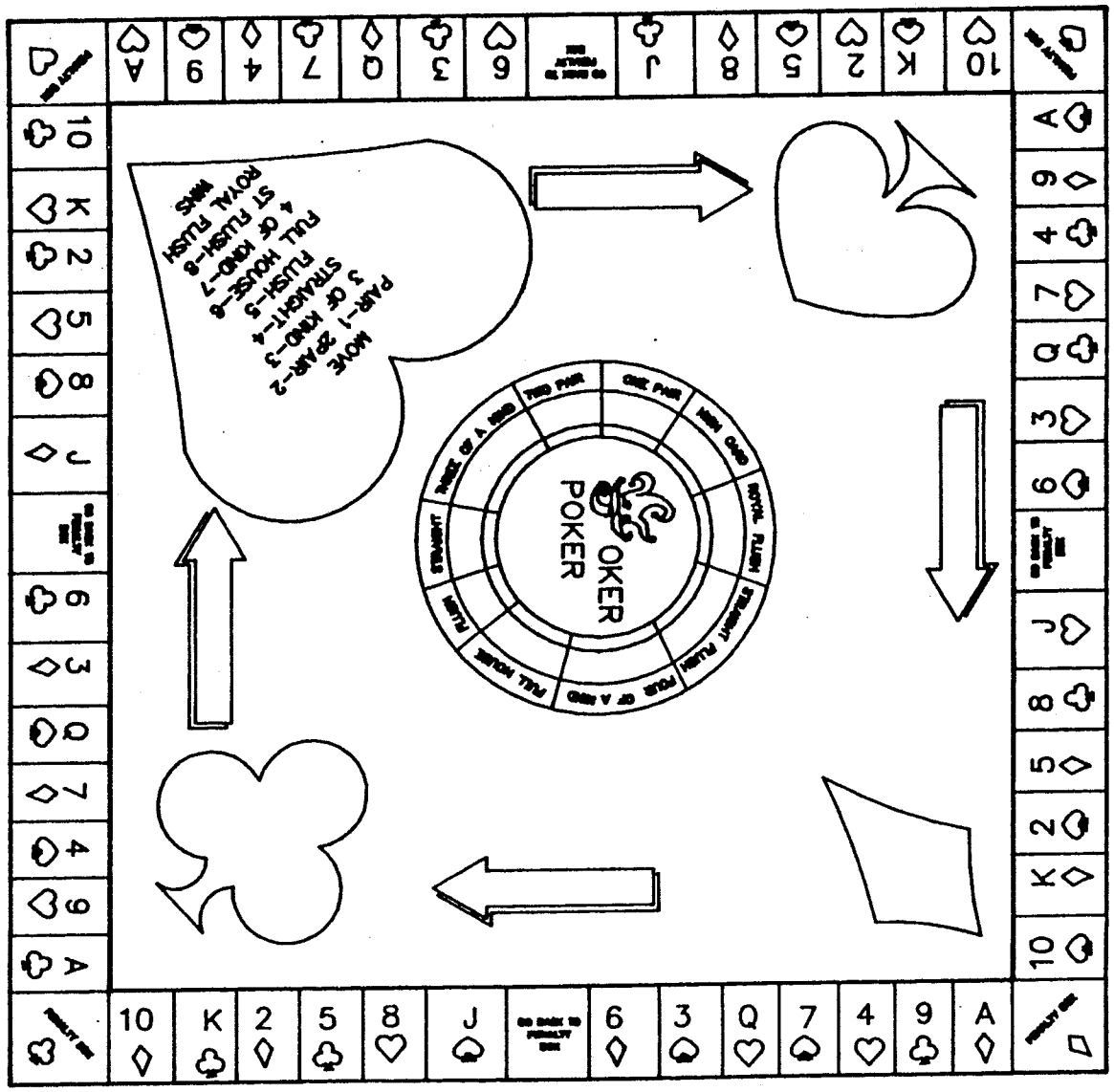
FIG. 10 is a plan view of an imitative-opponent board game's playing surface; it is used in the embodiment of FIG. 13.

Detailed Description—FIG. 10

FIG. 10 shows the design of the playing surface of a board and video game version of our invention. The center of the board gives the odds and the starting spaces are clearly marked. The board also indicates to the player how the marker is to be moved. The flowchart of FIG. 13 explains how this game board is used in the play of the game.

Figure 2A:
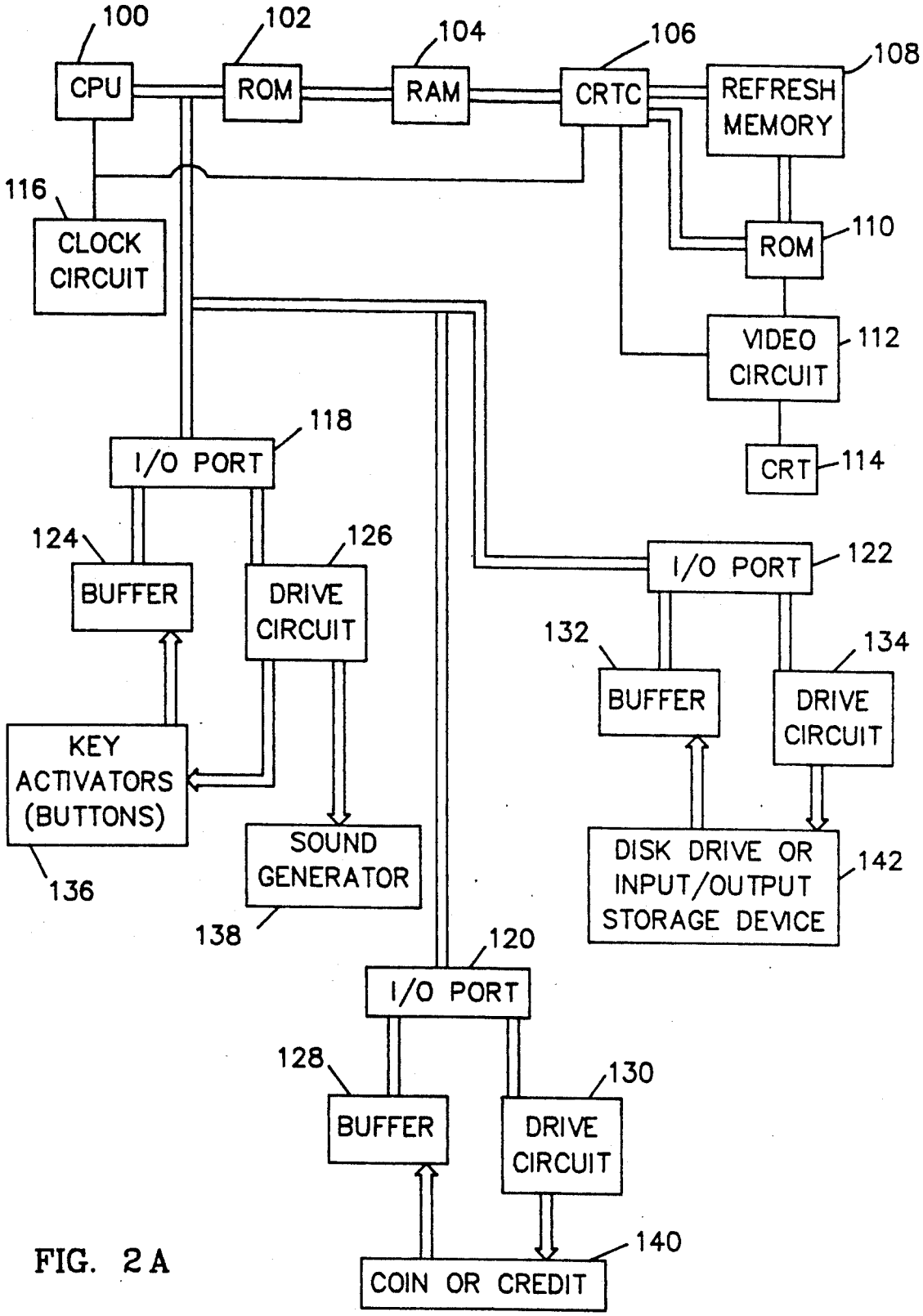
FIG. 2A is a circuit block diagram of the video poker game machine of FIG. 1A.

Detailed Description—FIG. 2A

FIG. 2A shows a block diagram of a circuit for our video poker game machine as shown in FIGS. 1A and 1B.

A CPU (Central Processing Unit) 100 executes various operations and processing while accessing memory locations in RAM (Random Access Memory) 104 based on a game program stored in ROM (Read Only Memory) 102. RAM 104 and ROM 102 make up the memory storage area. RAM can be written on and the contents altered. ROM is also a random access memory, but it cannot be written on and contents are not erased when the power supply is turned off. RAM is more properly called "Read And Write Memory".

The CPU controls the input/output of I/O port 118 which includes key activators 136; these control the buttons for dealing, folding, betting, etc.

CPU 100 also executes input/output operations of permanent mechanical storage devices such as a magnetic disk, magnetic tape, and cartridges 142 through I/O port 122.

CPU 100 further controls a coin operation or credit setting device 140 through I/O port 120.

Memory 108 is cleared and restored by the operating control of CPU 100 from a poker game program in ROM 102 or RAM 104. A CRT Controller 106 reads out the image pattern (memory bit maps) of the playing and makes a conversion of parallel data to serial data. This serial data is transmitted to a video circuit 112 and a predetermined image is displayed on a CRT 114, based on the video signals.

A clock circuit 116 sends out clock signals to control the timings of CPU 100 and CRT controller 106. Also, a buffer 124 holds instruction input information from key activators 136. A drive circuit 126, which performs lighting operations, i.e., it causes appropriate keys to light, in response to inputs from key activators 136. Sound is generated for the game in a sound generator 138. Various timings are also used for game prompts and the like.

A drive circuit 130 drives a coin/credit detection device 140 to execute a credit detection and release operation. Also, a buffer 122 holds the input from a memory storage device such as a disk drive 142, and CPU 100 directs the flow into RAM 104. A drive circuit 134 drives a memory storage device 142, which stores and supplies data and statistics.

It should be understood that many details of the type which would be obvious to one skilled in the art have been omitted. For example, detailed aspects regarding timing have been omitted to prevent obfuscation of the more pertinent aspects of the invention. However, such timing aspects, as well as other more commonly occurring considerations, are well known in the art.

Detailed Description—FIG. 2B

FIG. 2B illustrates the various programs kept in ROM or RAM storage for retrieval and interrogation. The ROM and RAM memories are shown in FIG. 2A at 102 and 104.

The answers to questions are found in ROM or RAM. Some of the questions might be: "Number of jokers?" "Type of Game?" and "Amount of bet?"

Responses to these questions are recorded in RAM and interpreted by the processor according to the steps contained in ROM or RAM.

Figure 3:
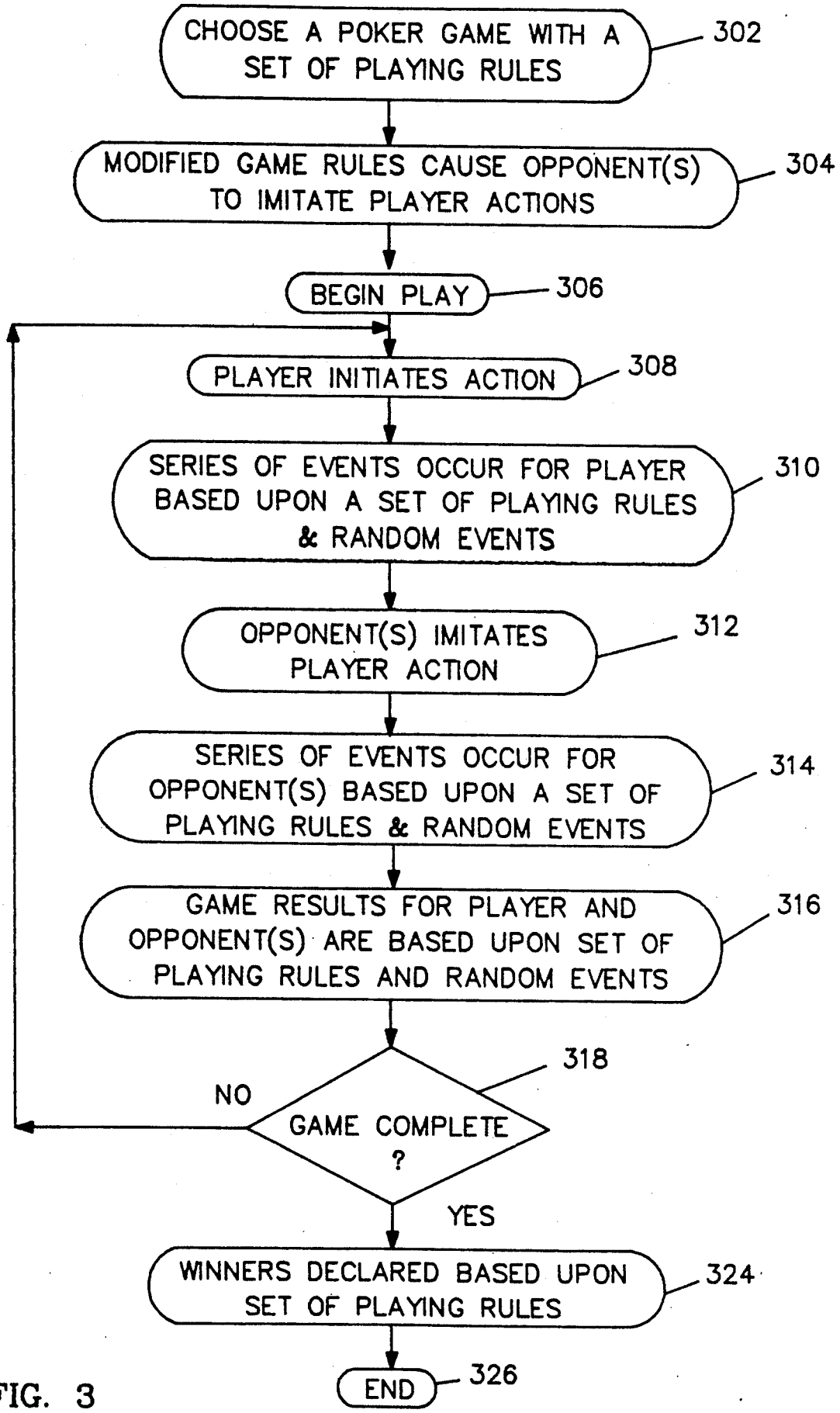
FIG. 3 is flow chart for a simple gambling game using imitative opponents which is used in the machine of FIG. 1A and in our board game, FIG. 1D.

Flow Chart For Imitative-Opponent Game—FIG. 3

FIG. 3 is a general flowchart for the simple gambling game which is the basis for our invention. The type of gambling game has been chosen and its rules have been modified to simplify the game for video play. The opponents imitate the lead player, and cannot initiate actions on their own, such as bluffing, raising, or folding.

The player starts the game (step 302) by selecting a set of playing rules from an appropriate game of chance suitable for imitative opponents with a lead player. It could be any type of game, including poker.

The game rules are modified to cause the opponents to imitate all actions of a lead player (step 304). Opponents cannot take intelligent actions on their own.

Play begins (step 306) with the player initiating a playing action (308) which is appropriate for this stage of the game.

A series of events will now occur for a player based upon a set of playing rules and random chance events (step 310).

The opponent imitates or matches the player's action (step 312) since opponents do not take intelligent actions on their own. This causes a series of events to occur for the opponents based upon a set of playing rules and random chance events (step 314).

Even though the opponent has imitated the player, the game results for a lead player and for an opponent will be different since random chance is involved for each (step 316).

If the game is now complete (step 318), the winners are declared based upon the set of playing rules (324) and the game ends (step 326). Otherwise, the player will initiate another action (step 308).

This general system is the foundation for the creation of all our game methods and devices according to our invention.

Figure 4:
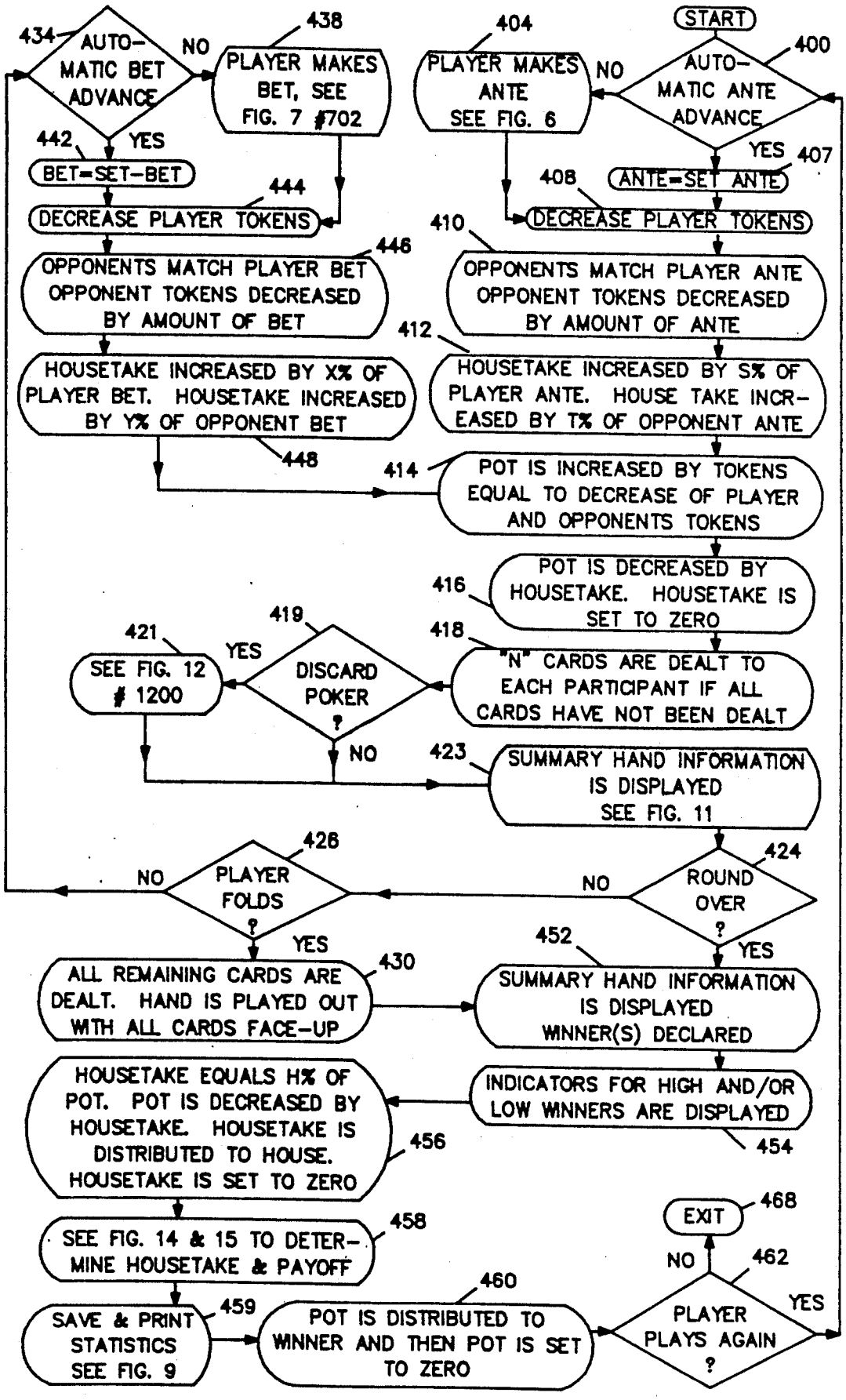
FIG. 4 is a flow chart for our imitative-opponent video poker game.

Flow Chart For Video Poker—FIG. 4

FIG. 4 shows a flow chart for a poker video poker game in accordance with the method outlined in FIG. 3. The computer opponents match the actions of a player, including player antes and bets. They have no initiative, and cannot raise, fold, check, or bluff on their own. A pot is built up by the player and such player's opponents. After a winner is determined, and if the player has won, the winnings are distributed to him or her, minus a houstake.

Figure 6:
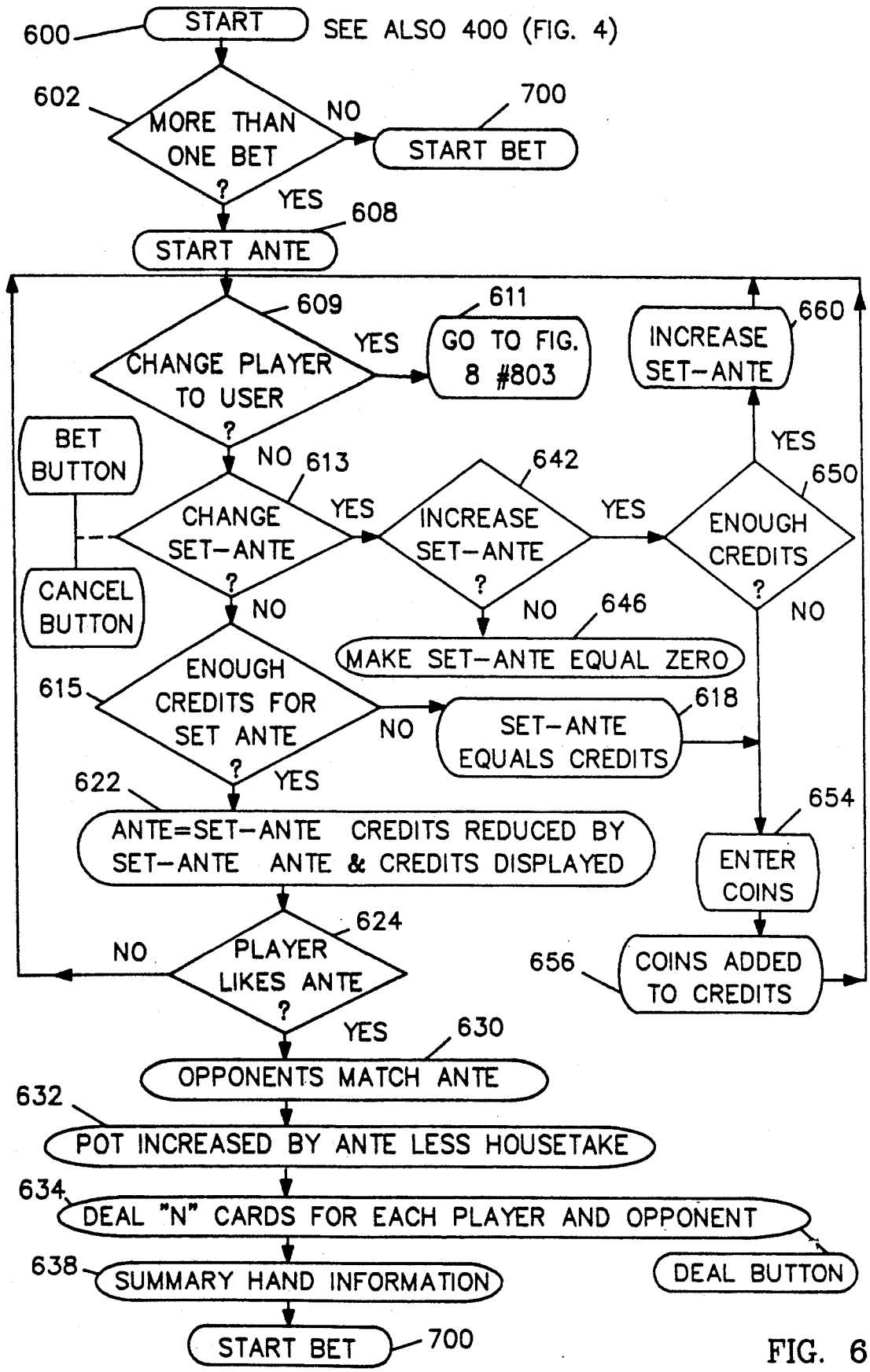
FIG. 6 is a flow chart showing how the ante is advanced manually by the player or automatically from credits with an automatic ante advance feature.

To speed up the game, an automatic ante advance feature (step 400) can be used where an ante is set equal to the set-ante (step 407) which stays the same throughout the game until the player changes it. The amount of the last ante is automatically advanced from credits if the player has sufficient credits as shown in FIG. 6. If the player does not want the same ante, he or she manually enters the ante (step 404).

The player's tokens are decreased by the amount he or she antes (step 408) and the opponents match the lead player's ante and opponents' tokens are decreased by the amount of the ante (step 410).

The housetake is increased by S% of the player's ante and the housetake is increased by T% of the opponents' ante (step 412) to allow for the assigning of different weights for player and opponents' antes. The weighting factors, S and T, are pre-set by the user at the video terminal or pre-set in the computer instructions.

The pot is increased by a number of tokens equal to the decrease of player and opponents tokens (step 414). The pot is now decreased by the housetake, and the housetake is set to zero (step 416).

"N" cards (appropriate to the stage of the game being played) are dealt to each participant (step 418). A random deal is insured by shuffling and cutting card decks using a random number generator before the first cards are dealt.

If the game allows for discards of cards (step 419) then discard and replace cards in step 421. See FIG. 12, step 1200.

Figure 11:
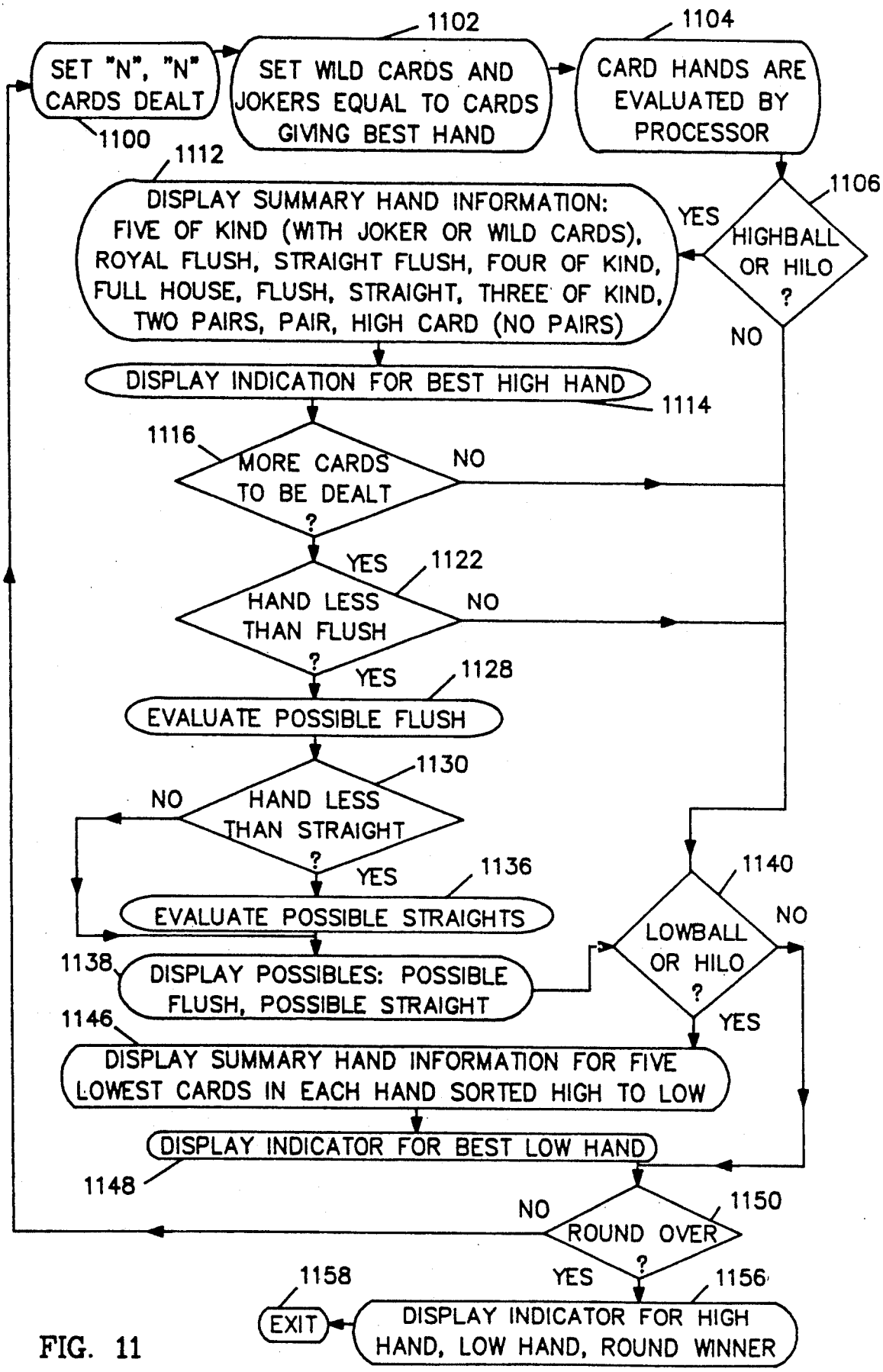
FIG. 11 is a flow chart showing how summary hand information is derived and displayed according to our game.

Summary hand information is provided (step 423) on or near each card hand to help the player discern the high hand for hiball, the low hand for loball, and the hand value of each hand (see FIG. 11).

If the round is over (step 424), proceed to step 452. If not over, determine if the player folded in step 426. If the player did not fold, then proceed to step 434. If the player folded, all dealt cards are turned faceup and the remaining undealt cards are dealt faceup. The player gets to see all hands faceup as if a game were completed normally (step 430). The flow chart continues to step 452.

If there is an automatic bet advance (step 434), the number of tokens equal to the set-bet is automatically advanced (step 442). If not, the player manually makes a bet (step 438), and continues to step 444.

A player's tokens are decreased (step 444) by the amount of the bet and the bet tokens are transferred to the pot. Since opponents have to match a player's bet, tokens from each opponent equal to the player's bet are transfered to the pot and opponent tokens are correspondingly reduced (step 446).

The housetake is now calculated and increased by X% of the player bets and Y% of the opponent bets (step 448) to allow for different weights for player bets and opponent bets. The weighting factors X and Y are pre-set by the user at the video terminal or pre-set in the computer instructions. The flow chart continues to step 414 as outlined.

If a round is over (step 424), the summary hand information is displayed and the winners are declared (step 452). A winning hand based on the best card hand value is determined and the high and/or low winners are displayed (step 454).

A final housetake is computed as H% (see FIG. 14) of the pot. The weighting factor, H, is pre-set by the user at the video terminal or pre-set in the computer instructions. The pot is decreased by the housetake and the housetake is set to zero (step 456). Look to FIGS. 14 and 15 in step 458 for housetake and payoff calculations.

Figure 9:
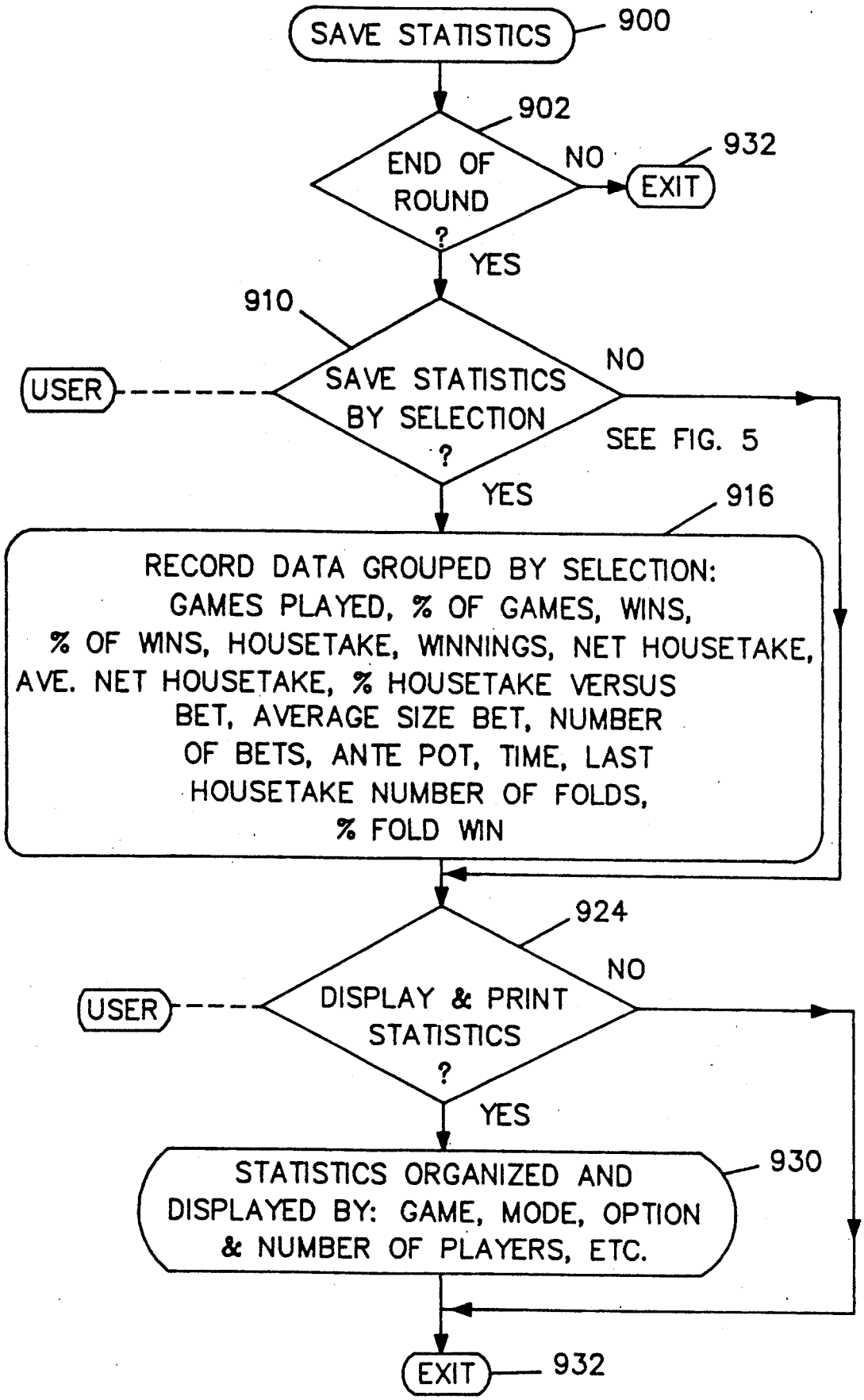
FIG. 9 is a flow chart showing how statistics are saved, stored, displayed, and used according to our poker game.

The user is able to save and print statistics (step 459) gathered during a game (see FIG. 9).

The round winnings (or the pot) is distributed to the winners (step 460). There can be multiple winners and the pot is split equally among the winners. The winnings due to the player is added to the credits. The pot is set to zero in preparation for the next round.

If a player wants to play again (step 462), he or she starts the game all over again by proceeding to a new round at step 400 (same as 600). If not, proceed to step 468 and exit.

Figure 5:
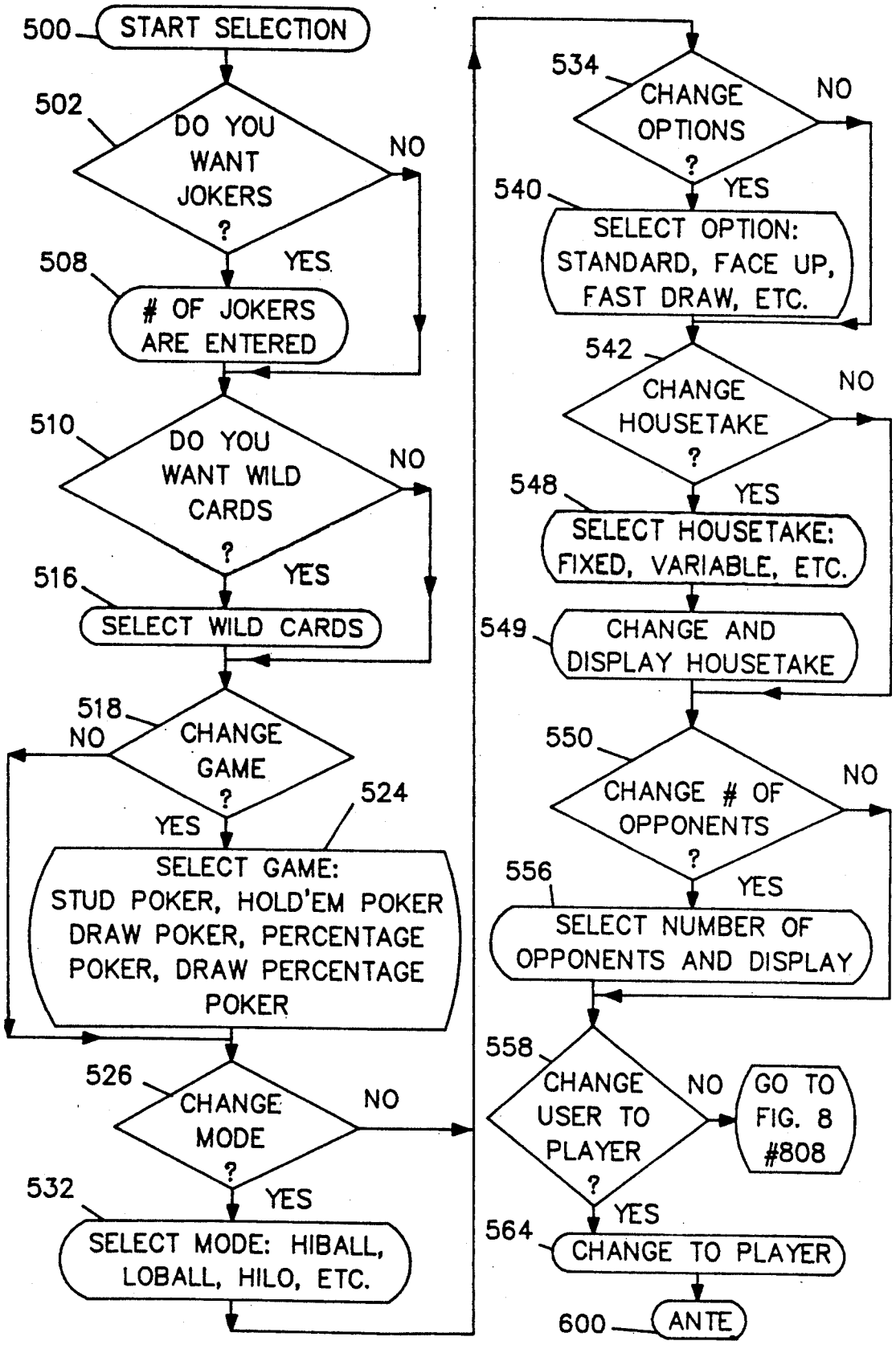
FIG. 5 is a flow chart showing the flexibility and variety of our imitative-opponent game selection process.

Flowchart For Selection Process—FIG. 5

FIG. 5 is a flow chart showing the flexibility of the selection process and the tremendous variety of games. These games are based upon the simple imitative-opponent game of FIG. 3 adapted to a video poker game of FIG. 4. The user may select wild cards or jokers. The game, mode, option, number of opponents, and the housetake can all be changed.

The selection process starts (step 500) by asking the user if he or she wants to change the number of jokers (step 502). If no, proceed to step 510. Otherwise, the number of jokers are entered (step 508) and jokers are added to or subtracted from the card deck(s). When jokers are selected, Random Access Memory (FIG. 2B) is modified to cause jokers to be displayed and used in the computation of hand values.

If the user does not want any cards to be made wild (step 510), proceed to step 518. If wild cards are selected (step 516), the selected cards are marked as wild (RAM, FIG. 2B). The wild cards are highlighted with the appropriate wild marking when they are displayed.

The user can change the game (step 518) by selecting a new game from Stud Poker, Hold'Em Poker, Percentage Poker, Draw Poker, Percentage Draw Poker or the like (step 524). The newly selected game is set in memory and displayed. If the user does not want to change the game, the flow chart proceeds to step 526.

If a user wants to change the mode (step 526) of a game, he or she selects a mode such as hiball, loball, hilo, etc. The newly selected mode is set in memory and displayed. If no new mode is desired, then proceed to step 534.

If the user wants to change options (step 534), he or she selects an option (step 540) such as Standard, Faceup, Fastdraw, Suicide, etc. The newly selected option is set in memory and displayed. If the user does not want to change options, proceed to step 542.

If the user wants the housetake changed (step 542), he or she selects the housetake from fixed housetake, variable housetake, player ante housetake, player bet housetake, opponent ante housetake, opponent bet housetake, etc. (step 548). The housetake is changed (step 549), set in memory (RAM, FIG. 2B), and displayed. If the housetake does not need to be changed, proceed to step 550.

If a user wants to change the number of opponents (step 550), he or she selects the number of opponents (step 556) which is set in memory (RAM FIG. 2B), and displayed. If there is no change in the number of opponents, proceed to step 558.

If the user wants to interchange with a player (step 558), he or she changes to a player (step 564) and is now able to play the newly selected game by proceeding to "Ante" step 600 (FIG. 6). If there is no interchange between player and user, proceed to step 808 in FIG. 8.

Flow Chart For Automatic Ante Advance—FIG. 6

FIG. 6 is a flow chart showing how an ante is advanced manually by the player or automatically from credits with an automatic ante advance feature. This automatic ante advance is a special feature of our video poker game described in FIG. 4. It speeds the game.

The player starts the game (step 600) which corresponds to step 400 in FIG. 4).

Figure 7:
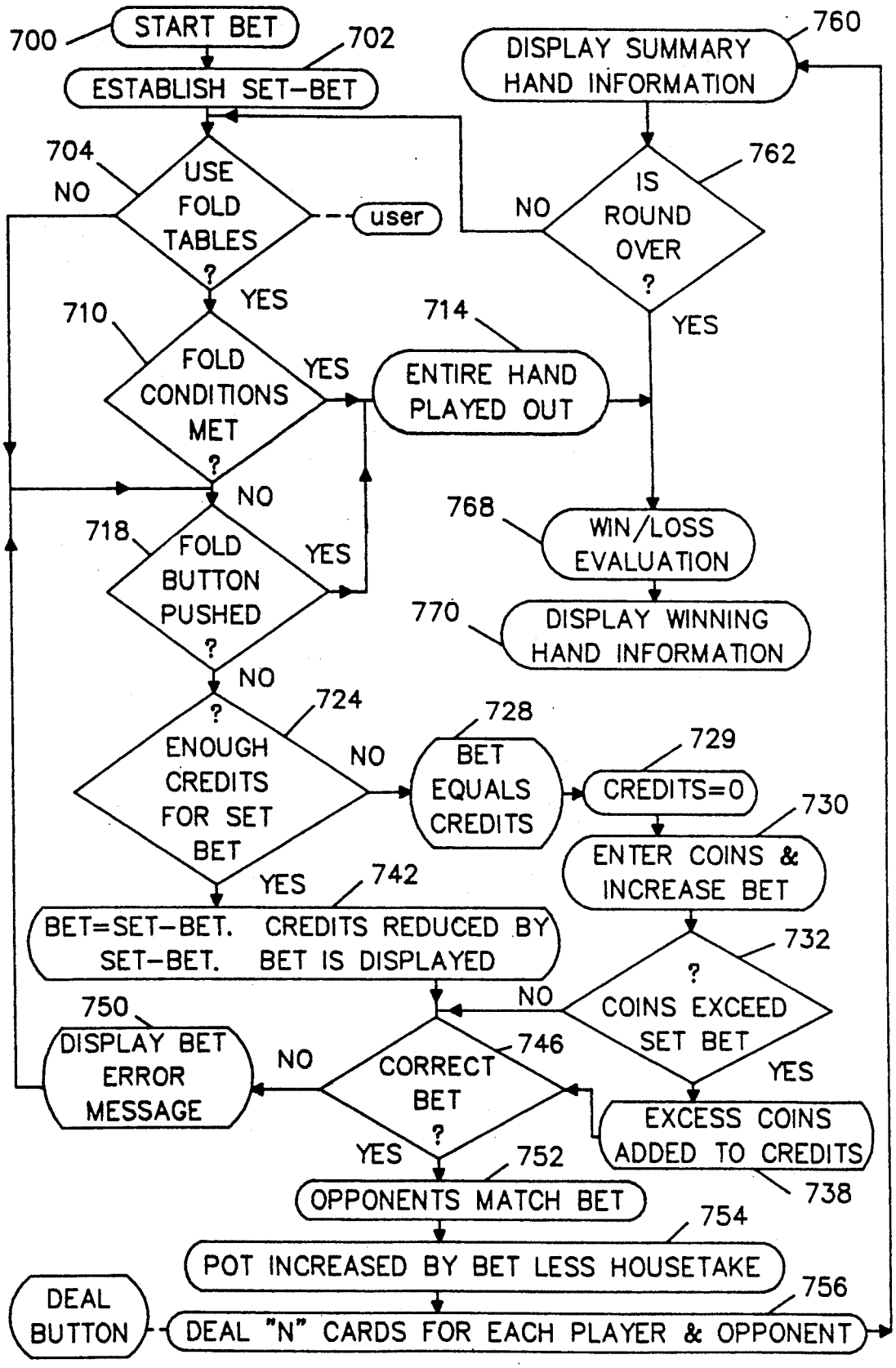
FIG. 7 is a flow chart showing how a bet is advanced manually by the player or automatically from credits with the automatic bet advance feature.

If there is only one bet (step 602), there is no ante and the player proceeds to bet at step 700 (FIG. 7). Some games do have multiple bets, while others have only one bet. The player starts the round by making an ante (step 608).

Figure 8:
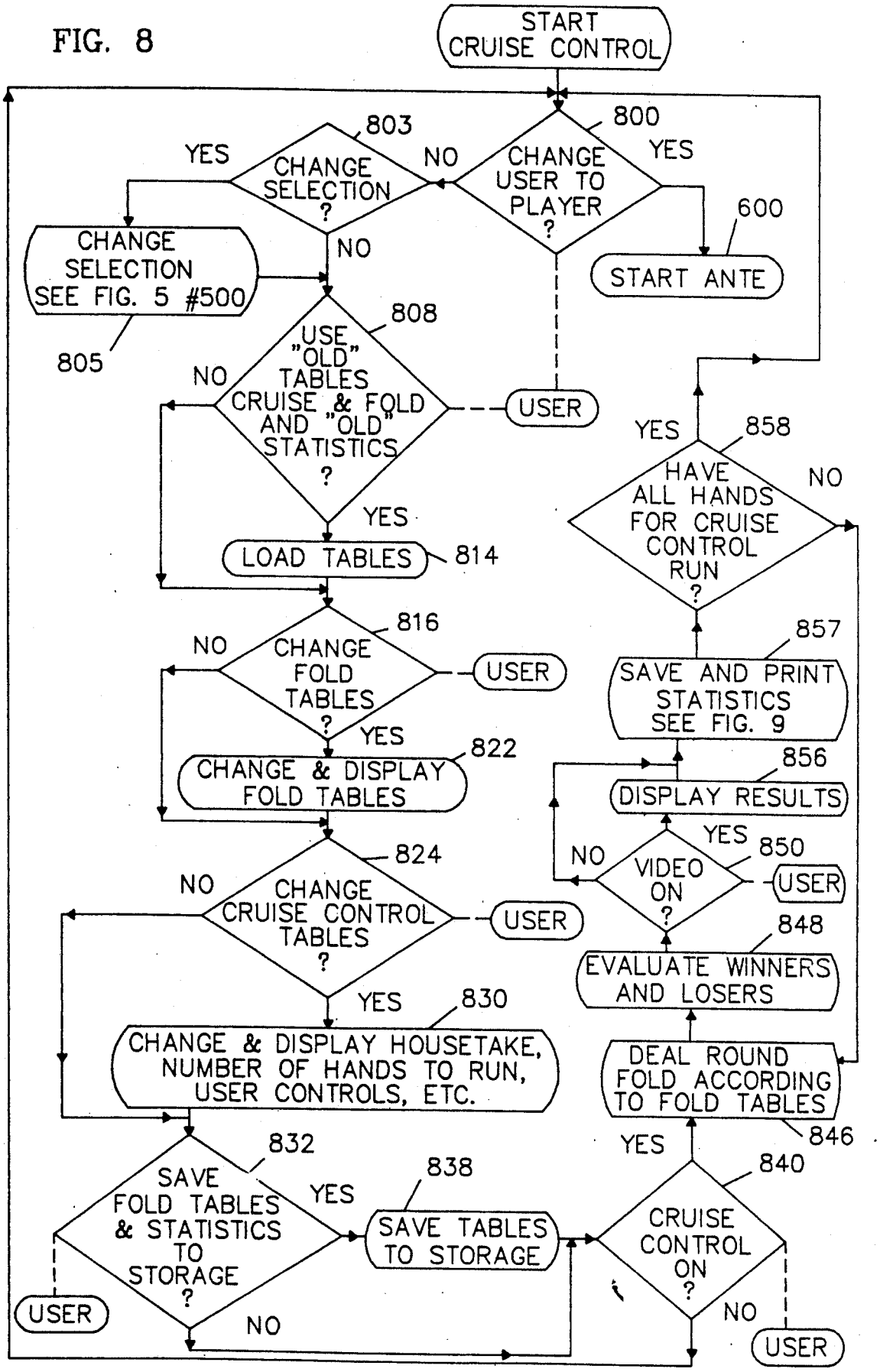
FIG. 8 is a flow chart showing how cruise control and fold tables operate according to our imitative-opponent poker game.

Only an owner can be both a user and a player. A non-owner is not allowed to be a user. The owner-player has the opportunity to become a user (step 609) by proceeding to step 611 (FIG. 8, step 803). Otherwise, proceed to step 613.

If the player does not want to change the set-ante (step 613) where the bet or cancel buttons have not been activated, proceed to step 615. Otherwise, proceed to step 642.

To determine if the player has enough credits for the present amount of the set-ante (step 615), the processor checks memory (RAM, FIG. 2B) for the amounts for the set-ante and credits. If the set-ante does not exceed credits, proceed to step 622. Otherwise, the set-ante is made equal to the available credits (step 618); then the program proceeds to step 654.

If there are enough credits for the set-ante amount, the ante is made equal to the set-ante (step 622). The player's credits are reduced by the amount of the set-ante. The new ante and credits are set in RAM and displayed.

The player approves of the selected ante (step 624) or the process is repeated by going to step 609. If the ante is correct, the opponents must match the player's ante (step 630).

The pot is increased by the ante less the housetake in step 632 (see also FIG. 4, step 412).

The cards are dealt to the player and each opponent (step 634) by the player activating deal button 58. The appropriate number of cards is dealt for the present stage of the selected game. The card images are obtained from memory (FIG. 2B), and displayed using an image generator and a CRT or the like.

Summary hand information is calculated and displayed (step 638) on or near the images of the dealt cards. Proceed to step 700 of FIG. 7 to initiate the betting process.

The player may change the set-ante (step 642). If the player wants to increase the set-ante, proceed to step 650. If a decrease is desired, the set-ante is set equal to zero (step 646) and proceed to step 615.

To increase the set-ante, the player must have enough credits (step 650) from previous winnings or deposits of coins. If not enough credits are registered in memory, the player must deposit coins in step 654. The inserted coins are added to the credits (step 656) in memory and displayed. Then proceed to step 609.

If there are enough credits (step 660), increase the set-ante. The whole process can be repeated again by going to step 609.

Flow Chart For Automatic Bet Advance—FIG. 7

FIG. 7 is a flow chart showing how the bet is advanced manually by the player or automatically from credits with the automatic bet advance feature. This special feature speeds up the play of the poker video game in FIG. 4.

The player starts the betting process (step 700) and the set-bet is established (step 702). It can be a fixed amount, an amount within a specified range, or a percentage of the ante. Once established, the set-bet is used to determine the required amount for all subsequent bets.

If fold tables are to be used (step 704) then a check is made to see if the fold conditions have been met which will cause a simulated player to fold (step 710). The fold tables are normally used by cruise control for a simulated player. If the fold tables are not going to be used, proceed to step 718.

If the fold conditions are met, the entire hand is played out (step 714) and the round is ended. Continue to step 768. If a player folds after a deal, all the cards to which he or she would have been entitled had the player not folded are still dealt to him or her. If the hand would have won, the player may not fold so hastily thereafter.

If the player folded by activating the fold button (step 718), proceed to step 714.

If there are not enough credits for the set-bet (step 724) then the bet is set equal to the credits (step 728), and the credits are set equal to zero (step 729). Coins are entered by the player to increase the bet (step 730) to the amount of the set-bet. If the coins entered exceed the set-bet (step 732), the excess coins are added to credits (step 738). Proceed to step 746.

If there are enough credits for the set-bet, the bet is set equal to the set-bet and credits are reduced by the set-bet. The new bet and credits are displayed (step 742).

If the bet does not equal the set-bet (step 746), a bet error message is displayed (step 750) and play proceeds to step 718.

If the bet is correct, the opponents match the player's bet (step 752), and the pot is increased by the bet less the housetake in step 754. (see also FIG. 4, step 448).

When the deal button is activated by the player (step 756), "N" cards (appropriate for that particular stage of the game) are dealt to the player and each opponent. The cards dealt are determined by random chance using generated random numbers.

After the cards are dealt (step 760), the summary hand information as explained in FIG. 11 is displayed (step 760) and it is determined whether the round is over (step 762). If not, proceed to step 704. Otherwise, proceed to step 768.

A win/loss evaluation (step 768) takes place by obtaining the hand rank for all hands. All combinations of cards for each hand are analyzed. The best hand rank wins. The hand rank is obtained by determining the hand order, then the card order within the hand order.

Figure 15:
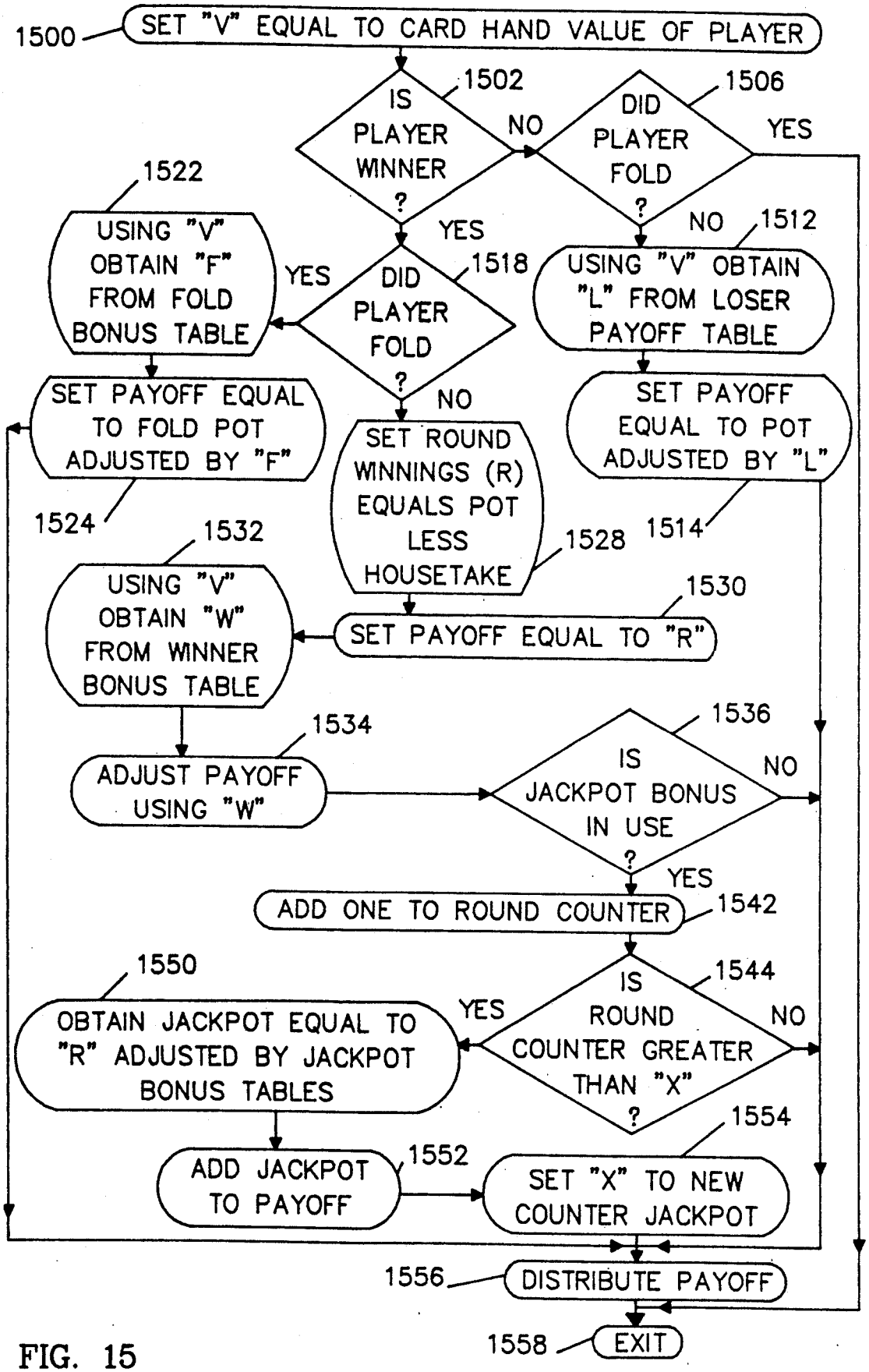
FIG. 15 is a flow chart showing the calculation of a payoff to the winners according to our game.

When the round is over, the winning hand information is displayed (step 770). At this point a variety of payoff schemes would come into play. FIG. 15 shows a payoff flow chart.

Flow Chart For Cruise Control—FIG. 8

FIG. 8 is a flow chart showing how cruise control operates. Cruise control is the name of a driver used to run computer programs by simulating a player. Cruise control automatically plays a specified number of rounds by simulating player actions with or without displays while allowing for user intervention. Cruise control automatically plays the poker video games outlined in FIG. 4. A proper housetake can be derived or verified by running thousands of rounds with cruise control.

Step 800 allows the user to become a player where cruise control is not involved. If he or she wants to become a player, proceed to play the game at step 600 (FIG. 6) by activating the ante button. If the user remains a user, continue to step 803.

The user has the opportunity to change the selection in step 803 (see also FIG. 5). If the selection is not changed, proceed to step 808. Otherwise go to step 805 to change the selection.

The user is given a choice whether or not he or she wants to use old stored cruise control tables, fold tables, or statistics (step 808). If he or she does not, then proceed to 816 without loading any old tables into memory.

User specified tables (step 814) and statistics are loaded from storage by accessing a storage device 19, or memory to retrieve cruise control tables, fold tables and statistics.

The user is given the opportunity to change the criteria in the fold tables (step 816). If no change is desired, proceed to step 824. If a change is desired (step 822), the user may change any of the fold criteria at the video console. The criteria comprise but are not limited to best hand showing, not best hand showing, and the following values: high card, second high card, single pair, two pairs, three of a kind, straight, flush, full house, four of a kind, straight flush, five of a kind, possible straight, possible flush, two suited cards and the like for hiball. Different but appropriate entries are available for loball.

The changed criteria are displayed (step 822).

If the user doesn't want to change the variables in the cruise control tables (step 824), proceed to step 832. If the user wants to make changes, he or she may change and display the housetake, number of rounds to run, video display controls and the user controls (step 830). The user controls allow the user to visually validate the correct operation of the fold tables.

The user may want to save cruise control tables, fold tables and/or statistics to storage (step 832). If not, proceed to step 840. If he or she does, the user specified tables or statistics are saved to disk or other storage device (step 838).

The user is given the opportunity to activate the cruise control (step 840). If the user does not turn on cruise control, then proceed to step 800. If the user turns cruise control on, a round is dealt as shown in FIG. 7, and fold conditions are evaluated according to the fold tables (step 846). When the fold criteria are met, the player will fold under the direction of the cruise control program.

The winners and losers are determined (step 848).

The user may have the video on or off (step 850). If he or she does not want to watch the games in progress and wants the games to be run quickly, the video flag is turned off and the program proceeds to step 857.

The game is displayed while cruise control is running (step 856), and the statistics that were gathered are saved and printed (step 857). The flow chart in FIG. 9 shows the statistics that can be gathered, saved and printed.

A check is made to see whether all the hands or rounds for cruise control have been run (step 858). If they haven't, proceed to step 846 and deal another round of cards. However, if all hands for cruise control have been run, proceed to the beginning at step 800.

Flow Chart For Statistics—FIG. 9

FIG. 9 is a flow chart on how statistics are saved, retrieved and used in our video poker games in FIG. 4. The statistics are applicable to all the selections from FIG. 5. All the above statistics can be gathered during the operation of cruise control in FIG. 8 or by the actual play of the video poker games by the player.

The statistics are gathered and stored when the round is over (step 900). A check is made to see if the round is over (step 902). If not, exit to step 932. If the round is over, a determination is made whether the user has specified what satistics should be saved (step 910). If no specification is made, proceed to step 924.

Statistics are saved and grouped by selection: games played, percentage of total games, wins, percentage of wins, housetake, winnings, net housetake, average net housetake, percentage of number of bets, last housetake, number of folds, percentage of fold wins, average housetake versus average bet, and the totals and averages for the size of the bet, ante, pot, time of play and other data (step 916).

If the user wants the statistics to be displayed and/or printed (step 924), they are retrieved from memory or external storage. The data is formatted and displayed or printed (step 930). The statistics are organized by: game, mode, option, number of players, etc. If the statistics are not to be printed and displayed, please exit (step 932). The statistical operation is complete.

Flow Chart For Summary Hand Information—FIG. 11

FIG. 11 is a flow chart showing how summary hand information is used in a poker video game as shown in FIG. 4. Summary hand information is needed by the player to quickly size up the relative value of the hands for complicated games with a large number of opponents. It provides much the same information that a casino card dealer would give to a player at a poker table.

"N" is the number of cards to be dealt for the present stage of the selected game (step 1100). After "N" is set, 'N' cards are dealt to the player and each opponent.

Wild cards and Jokers are set equal to those cards which give the best possible high hand for hiball games and the best possible low hand for loball games before evaluation of hands (step 1102). After every parameter is set, the card hands are evaluated to find the best hand rank for each hand (step 1104).

A check is made to determine if hiball summary hand information is necessary (step 1106). If not, proceed to step 1140. Otherwise, the summary hand information for hand ranks are displayed next to the associated card hands. The displayed summary hand information includes: five of kind (with joker or wild cards), royal flush, straight flush, four of kind, full house, flush, straight, three of kind, two pairs, pair, and high card (step 1112)

The best high hand information is displayed next to the associated best hand (1114).

A check is made to see if more cards are to be dealt this round (step 1116). If not, proceed to step 1140.

If the hand rank is less than a flush (step 1122), the hand is evaluated for possible flushes. If the hand is a flush or better, proceed to step 1140.

If the hand rank is less than a straight (step 1130), the hand is evaluated for possible straights (step 1136). If it is a straight or better, proceed to step 1138.

Summary hand information is displayed for all possible flushes or possible straights next to the appropriate hands (step 1138).

A determination is made whether loball summary hand information is necessary (step 1140). If not needed, proceed to step 1150. Otherwise, the cards in each hand are sorted from high to low (step 1146). The summary hand information is for the five lowest cards in each hand and is displayed next to the associated hand.

The best low hand information is displayed (step 1148) next to the associated hand.

A check is made to determine if the round is over (step 1150). If not, proceed to the beginning at step 1100. Otherwise, display the high hand winner and the low hand winner (step 1154) as derived from the best hand ranks. The round or game is now over. Continue to step 1158.

Figure 12:
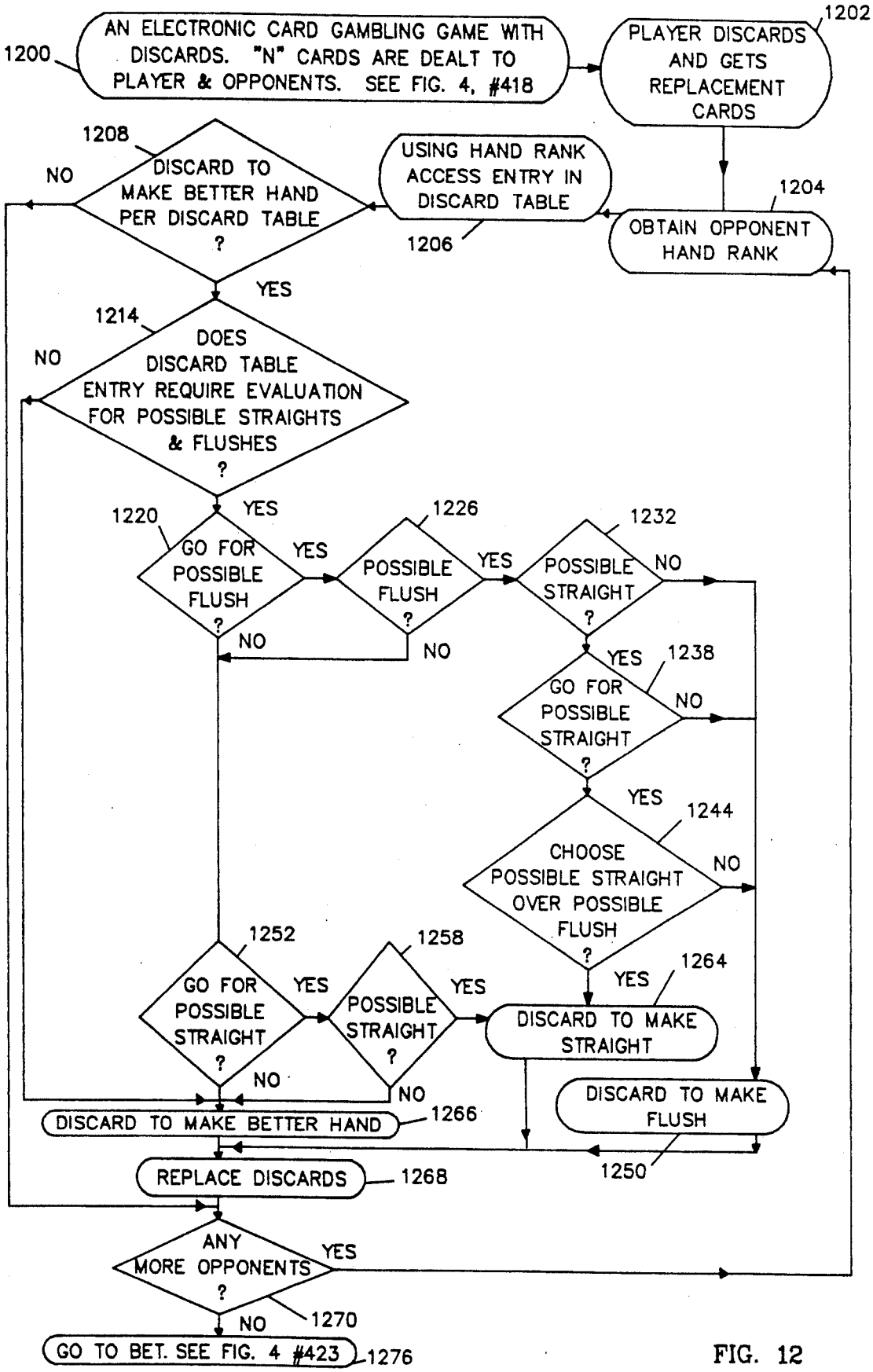
FIG. 12 is a flow chart of a draw poker game using imitative-opponents.

Flow Chart For Draw Poker—FIG. 12

FIG. 12 is a flow chart of draw poker using the same imitative-opponent poker video game as in FIG. 4 but with an expansion of step 418. This figure shows how discards of cards and their replacements are handled.

"N" cards (appropriate for the type and stage of the game) are dealt to each participant (step 1200) and displayed accordingly.

The lead player discards the cards not wanted and gets randomly selected replacement cards (step 1202).

The hand rank is obtained for each opponent's hand (step 1204) which will be used to access a discard table to determine which cards the opponent will discard (step 1206). To discard intelligently, the following series of determinations are made.

First, it must be determined whether the opponent's discard table (step 1208) allows discards for the hand rank. If not proceed to step 1270.

Second, it must be determined whether the discard table entry requires evaluation for possible straights or possible flushes (step 1214). If not, proceed to step 1266.

Third, it must be determined whether the discard table requires the opponent to go for a possible flush (step 1220). If not, proceed to step 1252.

Fourth, it must be determined if the opponent hand has a possible flush. (step 1226). If not, proceed to step 1252.

Fifth, it must be determined whether the opponent hand has a possible straight (step 1232). If not, proceed to step 1250. Then it must be determined whether the discard table requires the opponent to try for a possible straight (step 1238). If not, proceed to step 1250. Then it must be determined (sometimes randomly) if the discard table requires the opponent to choose a possible straight over a possible flush (step 1244). If not, proceed to step 1250.

If the discard table determines, discard to try to make the flush (step 1250) and go to step 1268. Otherwise, the opponent discards to try for a straight (step 1264), and proceeds to step 1268.

Sixth, must be determined whether the discard table requires the opponent to go for a straight (step 1252). If not, proceed to step 1266.

Seventh, it must be determined if the opponent hand has a possible straight (step 1258). If not, proceed to step 1266. The opponent discards to try to make a straight (step 1264) and proceeds to step 1268.

The opponent's cards are discarded in accordance with the discard table directions (step 1266), and all the discards from the opponent's hand are replaced with randomly selected cards (step 1268).

A check is made to see if all opponents have been processed (step 1270). If not, proceed to the next opponent at step 1204. Otherwise, all opponents have been processed and it is time to bet. Proceed to step 1276 (FIG. 4, step 423)

Figure 13:
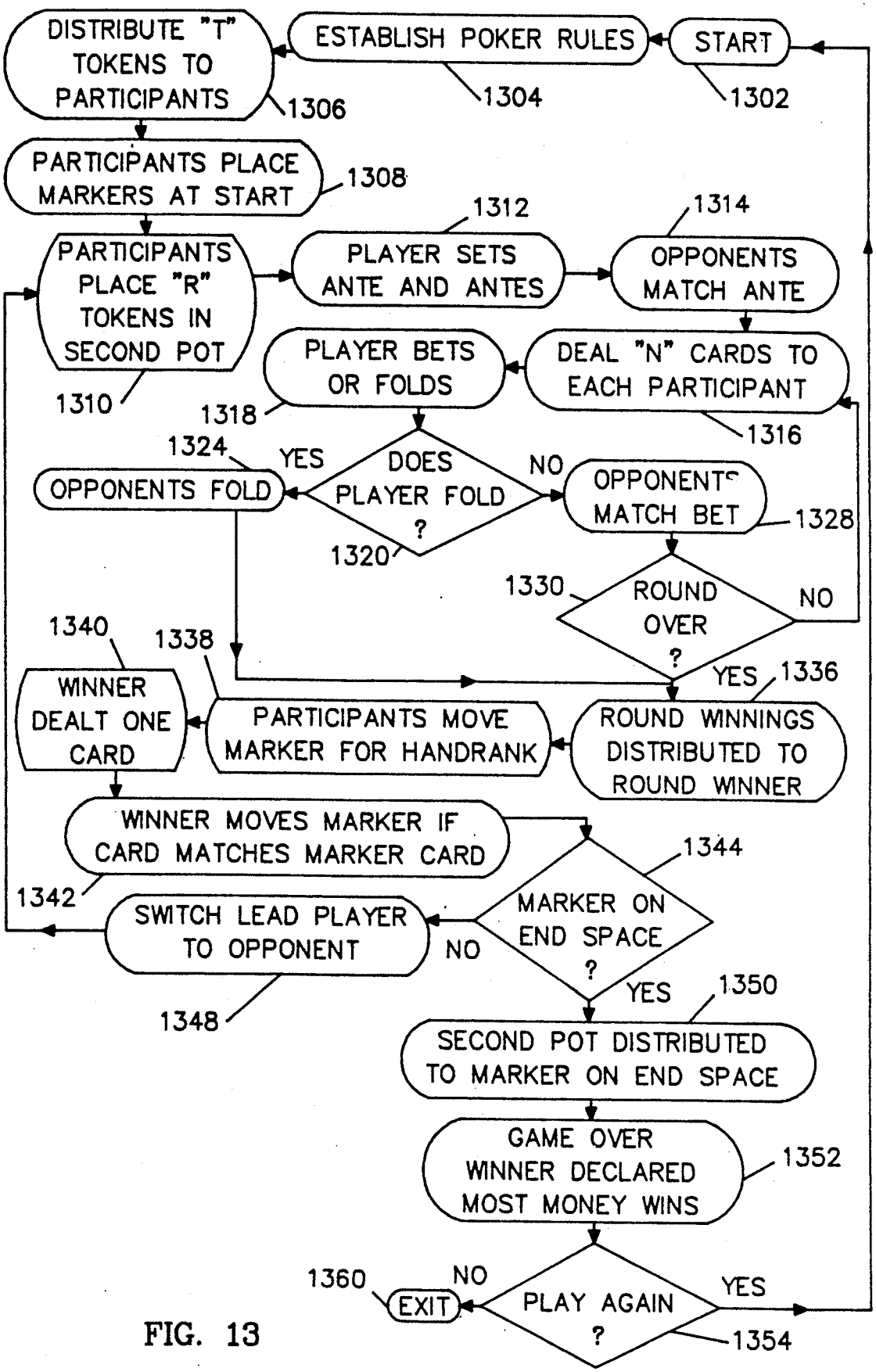
FIG. 13 is a flow chart showing step by step, how to play an imitative-opponent board game.

Flow Chart For A Poker Board Game—FIG. 13

FIG. 13 is a flow chart depicting the play of the poker board game of FIG. 10, which can be used for a video game and as a table board game. Start the game (step 1302) by establishing which poker rules (step 1304) will be used. Any poker game can form the basis for the board game. Replicas of cards appear within spaces on the board. The player includes in his or her hand the card indicated by the replica when his or her marker lands on the corresponding space.

"T" tokens (chips, tokens, or money) are distributed (step 1306) to each of the participants.

The participants place markers at their respective start spaces (step 1308).

Each participant places 'R' tokens (as agreed upon) in a second pot (step 1310). This second pot is not to be confused with the pot that is won at the end of each hand or round. There are two pots in this game.

Step 1312. The lead player for this round sets the amount of the ante and then antes (FIG. 4, step 404, indicates how the player makes the ante in the video version of the board game.)

Since the rules require that the opponents (live or computer simulated) must imitate the lead player, the opponents match the ante of the lead player (step 1314).

"N" cards (appropriate to the stage of the game being played) are dealt to each participant (step 1316). Each participant includes the extra marker card in his or her hand with the other cards (see description under steps 1302 and 1324, supra) dealt.

After evaluating his or her hand, the lead player bets or folds (step 1318).

If the player folds (step 1320), each opponent must imitate the lead player and fold also (step 1324), then proceed to step 1336.

If the player did not fold, the opponents imitate the player's bet (step 1328). (FIG. 4, steps 426 and 430, indicate how a fold is handled in the video game.

A check is made to determine if the round is over (step 1330). If not, proceed to step 1316. If the round is over, round winnings are distributed to the round winner (step 1336). Only the round winnings are distributed each round. The second pot is not distributed until the end of the game and it keeps building each round.

After each round, all the participants move their markers (step 1338) in accordance with a point system awarded for the hand type of their hand. (E.g. a pair may be awarded one space). If a participant lands on a penalty space, then he or she must go back the number of spaces specified by the rules. Each participant moves his or her marker according to the point system assigned to the hand type of his or her card hand after the round is over.

The winner is dealt one extra card (step 1340) which gives him or her a chance to move his or her marker additional spaces according to the extra card (step 1342). The number of additional spaces depends upon the match of the newly drawn card with the new marker card. If the suits match, the marker is moved to the next marker card with the same suit; if the numbers match, his or her marker is moved forward by a number of spaces equal to the card number. If the number and suit both match, the participant takes advantage of both moves, first the number move and then the suit move, or vice-versa.

If a marker is on an end space, proceed to step 1350.

If the game is not over (step 1344), the lead player switches places with an opponent (step 1348), whereby the player becomes an opponent and an opponent becomes the lead player. Proceed to a new round at step 1310.

If the game is over, the second pot is distributed to the participant with his or her marker on an end space (step 1350).

The game is officially over (step 1352). An accounting of the tokens are made by counting the tokens from all round winnings plus all the winnings from the second pot. The player with the most tokens is declared the winner. (FIG. 4 indicates how to video version of the game ends.

A check is made to see if another game is to be played (step 1354). If yes, proceed to the beginning at step 1302.

Exit from the game (step 1360).

Figure 14:
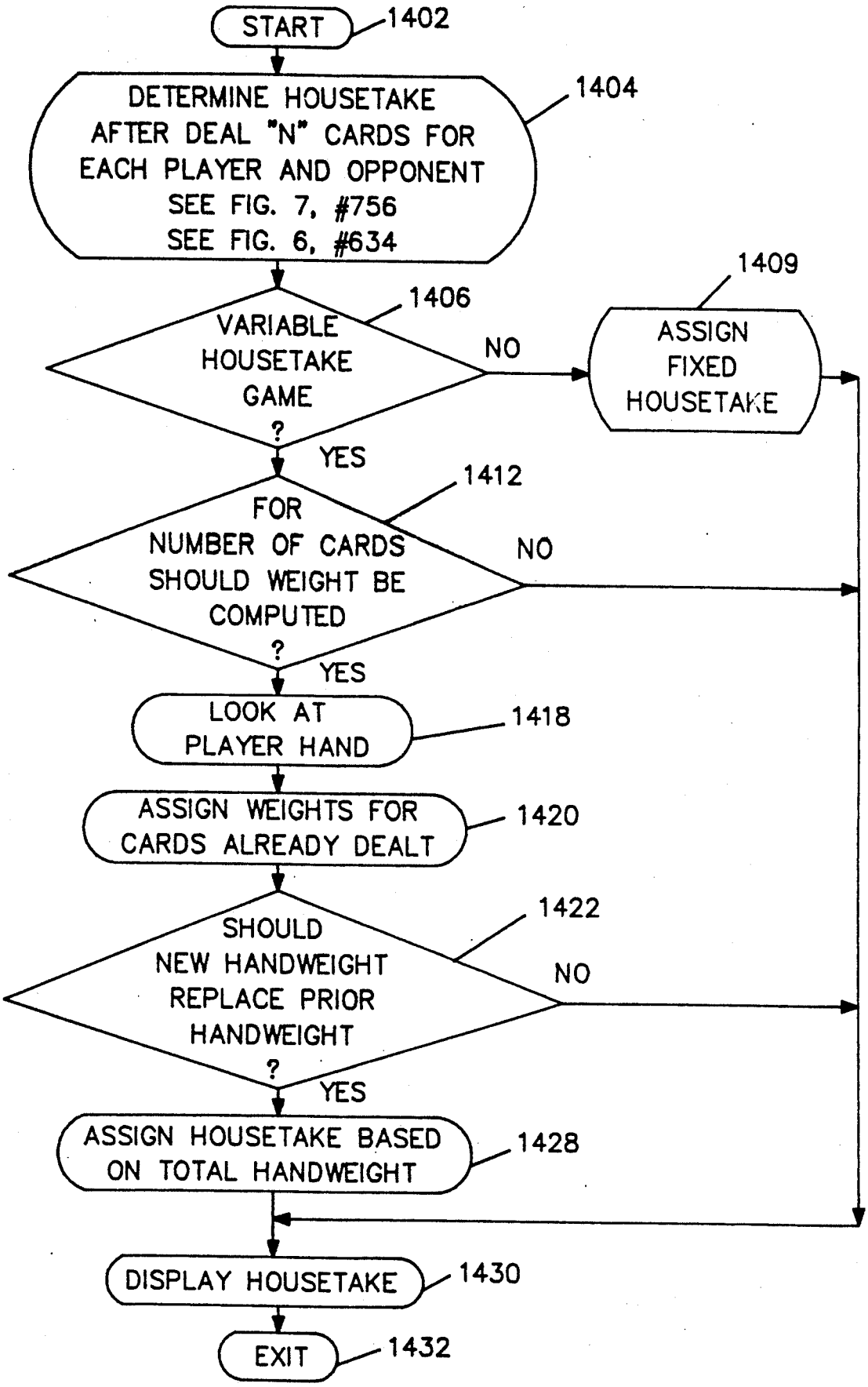
FIG. 14 is a flow chart explaining how to determine the housetake (fixed or variable) used according to our game.

Flow Chart For A Housetake—FIG. 14

FIG. 14 is a flow chart for the determination of the housetake (fixed or variable). The housetake is kept by the owner of the poker video game of FIG. 4.

Before the determination of the housetake (step 1402), "N" cards (appropriate for the stage of the game) are dealt to the player and each opponent (step 1404). The player and each opponent antes (and bets). The housetake is adjusted according to assigned weightings. This step is identical to step 634 in FIG. 6 and also step 756 in FIG. 7.

It must be determined whether the game uses the variable housetake feature (step 1406). If this game does not, a housetake is assigned from a fixed housetake table, (step 1409), then proceed to step 1430.

A determination is made whether weights should be computed for the number of cards dealt so far (step 1412). If not, proceed to step 1430. Weights are computed and assigned (step 1420) from a variable housetake table, based only on the cards dealt to the player (step 1418).

A determination is made whether the new handweight should replace a prior handweight (step 1422). If not, proceed to step 1430. Very often, new cards will result in a worse hand. A decrease in the housetake may be used to entice a player to continue playing with a poor hand.

The prior handweight is replaced, or if there wasn't an existing one, then one is assigned (step 1428). The housetake or the payoff percentage is displayed (step 1430).

When a payoff percentage is displayed, the player knows how much he can win with a winning hand. Since round payoffs are different for each round of a variable housetake game, a new game results which is called percentage poker.

The game exits the housetake computation in step 1432.

Flow Chart For A payoff—FIG. 15

FIG. 15 is a flow chart showing the calculation of the payoff to the winners. This flow chart also outlines various bonuses for jackpot rounds, winners, losers, and winning folded hands. These payoffs are used for the poker video games in FIG. 4.

First a value "V" is set equal to the card hand value or rank rank of the player (step 1500).

If the player is a winner (step 1502), proceed to step 1518. Otherwise, if the player both lost and folded (step 1506), proceed to step 1558. If the player lost, use "V" to obtain 'L' from the loser bonus table (step 1512). Set the payoff equal to the pot or player total bet (step 1514) adjusted by "L". Proceed to step 1556.

If the player had a winning hand, but folded (step 1518), the player may be entitled to a fold payoff. Use 'F' to obtain 'F' from the fold bonus table (step 1522), and set the payoff equal to the fold pot (step 1524) adjusted by 'F'. Proceed to step 1556.

If the player won and did not fold (step 1528), set the round winnings ("R") equal to the pot less the housetake. Set the payoff equal to ("R") (step 1530).

Use 'W' to obtain 'W' from the winner bonus table (step 1532), and adjust the payoff using ("W") (step 1534).

If the jackpot bonus is in use (step 1536), add one to the jackpot round counter (step 1542). If not, proceed to step 1556.

Is the jackpot round counter greater than "X" (step 1544) where "X" is defined in the jackpot bonus table as a variable equal to the number of rounds between eligibility for the jackpot bonus? If it is not greater, proceed to step 1556.

Step 1550. Obtain the jackpot equal to ("R") adjusted by the jackpot bonus tables (step 1550), and add the jackpot to the payoff (step 1552).

Set the jackpot counter to zero (step 1554). Set a new "X" by generating a random number between zero and a range number, subtracting the random number from ½ the range number, and adding the result to a base number of rounds to obtain a new number of rounds ("X"). This determines when the next eligible jackpot bonus round will occur.

The payoff is distributed (step 1556), and the payoff is complete (step 1558).

Figure 16:
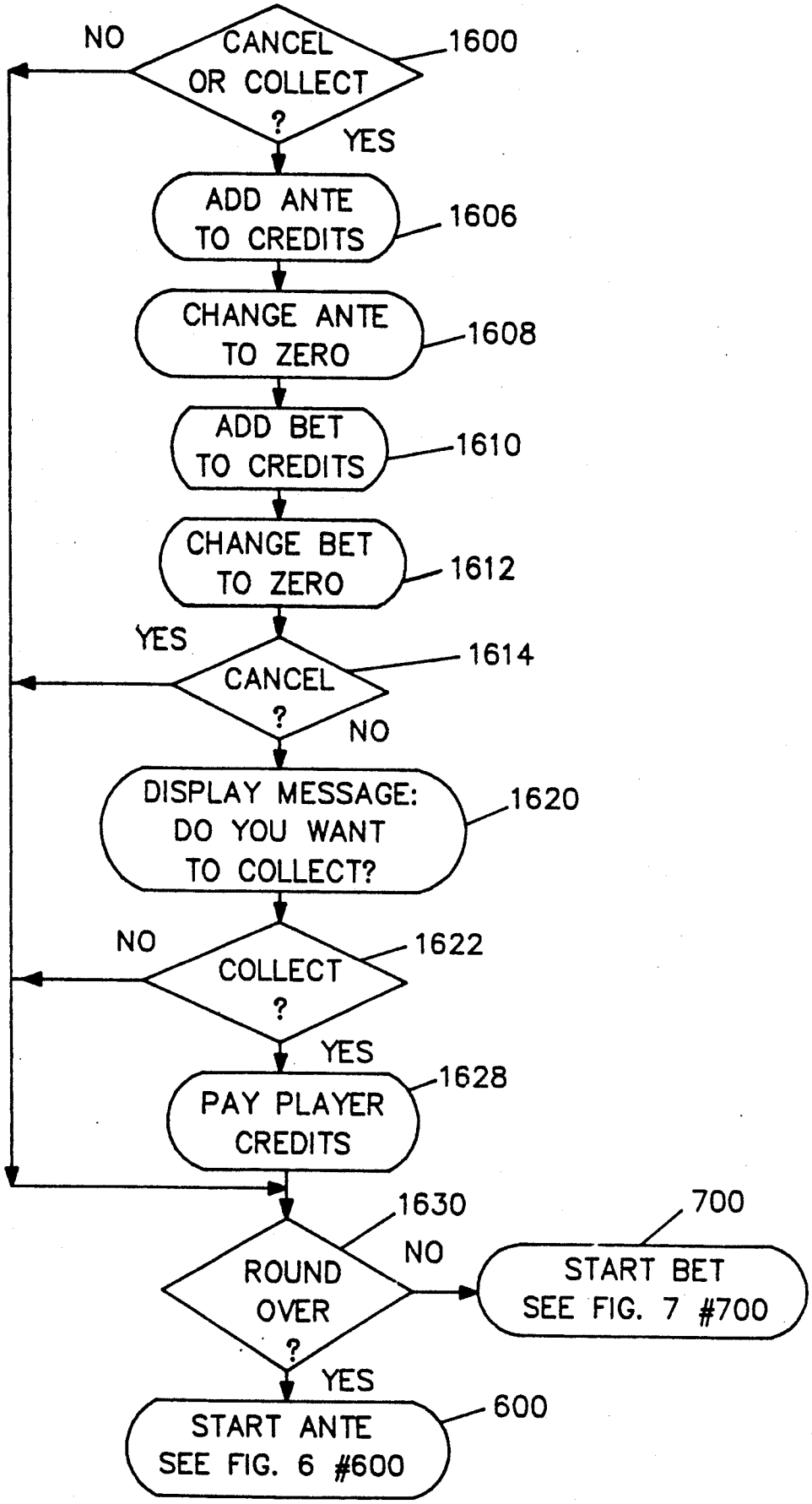
FIG. 16 is a flow chart outlining how the cancel and collect actions work when activated by a player.

Flow Chart For Cancel And Collect—FIG. 16

FIG. 16 is a flow chart outlining how the cancel and collect actions work when activated by a player. The collect actions allows a player to collect winnings from the poker video games in FIG. 4.

It must be determined if the player has taken a cancel or collect action (step 1600). If not, proceed to step 1630. Otherwise, add the ante to the credits (step 1606), and set the ante to zero (step 1608). Add the bet to the credits (step 1610), and set the bet to zero (step 1612).

If the cancel action was taken (step 1614), proceed to step 1630. Otherwise, a message is displayed (step 1620) asking the player to confirm that he or she does want to collect the credits (i.e. convert the credits to chips, coins, etc.). If the player does not want to collect, proceed to step 1630.

When a player is given a second chance to confirm a collect action by pushing the collect button again (step 1622), the player's credits are paid in tokens, cash or other medium of exchange (step 1628). Otherwise, proceed to step 1630.

A check is made to see if the round is over (step 1630). If not, proceed to "start bet" (FIG. 7, step 700). Otherwise proceed to "start ante" (FIG. 6, step 600).

Figure 17:
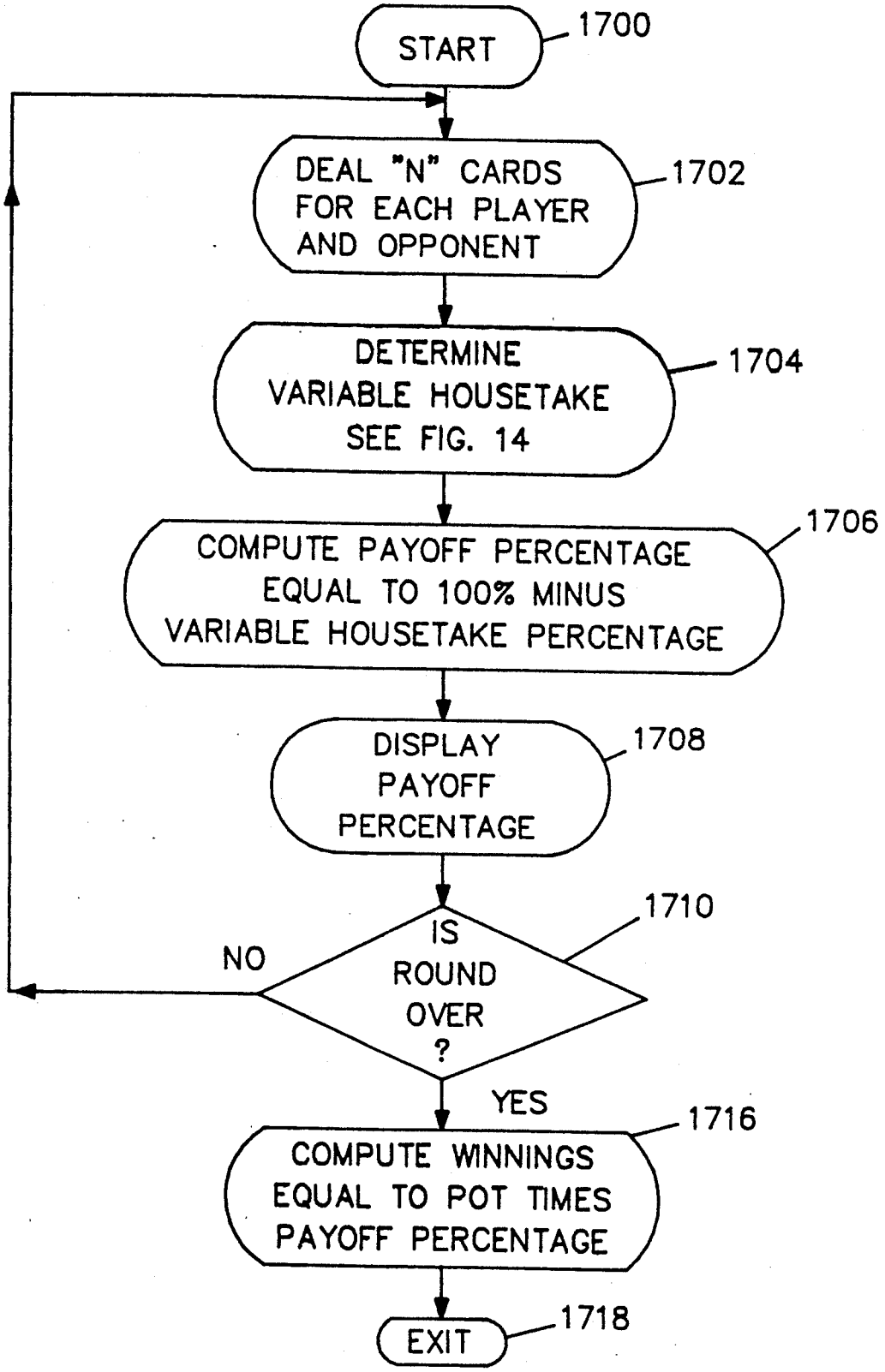
FIG. 17 is a flow chart of a new game called percentage poker.

Flow Chart For Percentage Poker—FIG. 17

FIG. 17 is a flow chart for the percentage poker game. Percentage poker is a spinoff from the variable housetake method of FIG. 14. Each round may have a different payoff based on a weighting system for the first few cards dealt to the player. The payoff percentages are displayed. The player then takes into account the resulting payoff opportunity to decide whether to continue depending upon his or her evaluation of the odds. This contrasts with other poker games which have the same fixed housetake method each round.

The player starts the game (step 1700) with 'N' cards (appropriate to the stage of the game) being dealt to the player and each opponent (step 1702). This corresponds to step 634 in FIG. 6 and step 756 in FIG. 7.

The variable housetake percentage is determined (step 1704). See FIG. 14 for the variable housetake flow chart.

The payoff percentage is equal to 100% minus the variable housetake percentage, the result multiplied by the number of players (step 1706) and is computed accordingly. If the result is less than 100%, it may be appropriate to set it to 100%. Display the payoff percentage (step 1708).

If the round is not over (step 1710), proceed to the beginning at step 1702. Otherwise, compute the round winnings as equal to the pot times the payoff percentage (step 1716), and exit (step 1718).

Flow Chart For Multiple Display Devices

Figure 18:
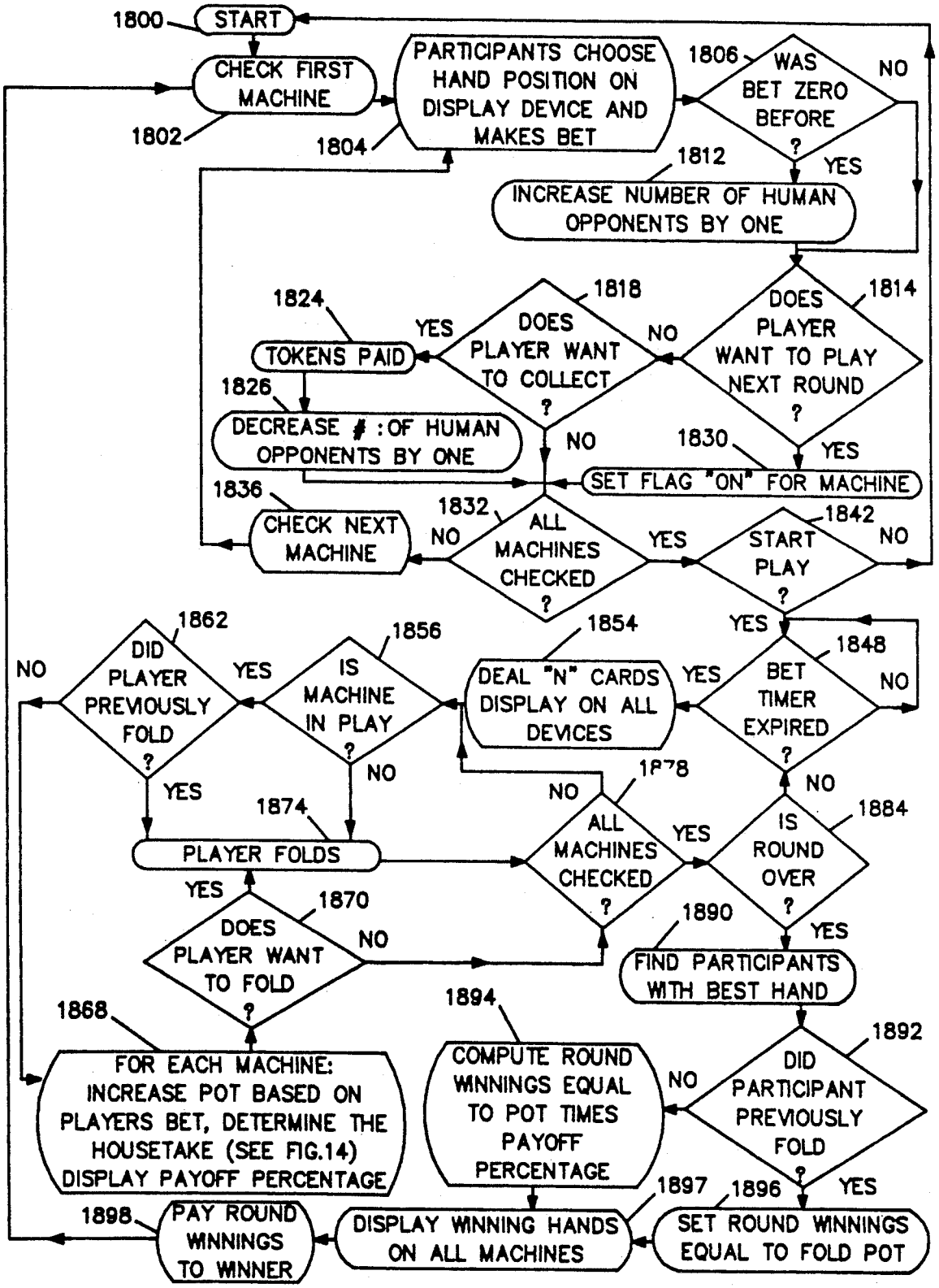
FIG. 18 is a flow chart showing how the same game can be played simultaneously on multiple display screens.

FIG. 18 is a flow chart showing how the same game can be played simultaneously on multiple display devices, with each device selecting a diffeent player hand position and allowing for different size bets on each device. The video poker games that are used are from FIGS. 4, 12, and 17. The video poker machine used is shown in FIG. 1A and the view with all the video poker machines hooked together is shown in FIG. 1C.

Start the game (step 1800) by checking the first machine (step 1802) in a string of machines, to see if it is actively being played. Active machines on-line is a parameter in the memory allocation for controlling the multiple devices.

A participant chooses his or her desired hand position on the associated display device and selects the size of his or her bet (step 1804) after depositing the necessary amount of money.

It must be determined if the bet was previously zero (step 1806) before the latest bet. If not, proceed to step 1814. Otherwise, increase the number of human opponents by one (step 1812).

If the player has decided to play the next round (step 1814), the activity flag is set to "ON" for that display device (1830), and proceed to step 1832.

If the player wants to collect (step 1818), the credits are paid in the form of tokens (step 1824) and the number of human opponents are decreased by one (step 1826). Proceed to step 1832.

If all the machines have not been checked (step 1832), the next machine is selected (step 1836) and proceed to step 1804.

A determination is made to see if it is time to begin play (step 1842) based on a timer or a switch action. If it is not time, proceed to step 1802.

If a bet timer has expired (step 1848), a player cannot take a bet or fold action. There is a limited time allowed for betting so other bettors (or display devices) will not have to wait. If the bet timer hasn't expired, the flow is looped back to step 1848 until the timer does expire.

If the bet timer has expired, deal "N" cards to each hand (appropriate for the stage of the game) and display on all devices (step 1854).

If the machine is in play (step 1856), determine if the player previously folded (step 1862). If the machine is not in play or if the player folded, proceed to step 1874.

For each machine; increase the pot based on the player's bet; for the selected hand position, determine the housetake (see FIG. 14) and display the payoff percentage (step 1868).

If a player folds (step 1870), a fold indicator is set so no more bets can be made on that device (step 1874). Proceed to step 1878.

A survey is made to determine whether all machines have been checked (step 1878). If not, select the next machine and proceed to step 1856.

If the round is not over (step 1884), proceed to step 1848.

The best hands are identified and, correspondingly, the best participant hands (step 1890).

If the participants previously folded (step 1892), set the round winnings equal to the fold pot (step 1896); otherwise, compute the round winnings as equal to the pot times the payoff percentage (step 1894).

Winning hands are displayed on all machines (step 1897), and the round winnings are paid to all winners (step 1898). The winnings can be different for each of the machines because of different hands and different size bets. In a percentage poker game, the payoff percentage can be different for tied winning hands depending on the first few cards that were dealt to each hand. Proceed to step 1802.

Video Poker Game—Operation—FIG. 1A

The following is a description of the operation of a single video poker game. This description is from the viewpoint of a player operating the video poker game machine of FIG. 1A. Assume that the user has already made the following game selection from the menu displayed (FIG. 7) at the start of the game: seven card stud (no wild cards or jokers), three opponents, standard option, hiball mode, and a fixed housetake (FIG. 5). The message for the housetake will remain the same throughout all rounds: "WIN PAYS X %", where X is the value of 100% less the selected fixed housetake percentage multiplied by the number of players.

A message, "INSERT COIN", flashes on the poker video screen until a player inserts a coin into coin inlet 54 (FIG. 1A). The amount of the coins entered is registered as credits (FIG. 4) and a messasge, "PLEASE ANTE", appears on video screen 60 (FIG. 1A). By pushing the ante button, the player enters the amount of ante desired and that amount will be automatically advanced from credits (FIG. 6) for all subsequent bets (FIG. 7) for the rest of the round as long as sufficient credits are available. An "ANTE OR DEAL" message is displayed and the player either increases the ante or pushes deal button 58 (FIG. 1A).

When the player causes a deal, three cards are dealt to each participant. Three cards are dealt to the opponents, two face down and one faceup. The player receives all three cards faceup. The summary hand information (FIG. 11) is displayed, indicating the hand rank for each hand and a display "HIGH OPPONENT" for the best opponent hand.

At this point of play the player also sees how much money has been contributed to the pot. The computer opponents have responded by imitating the player and have bet the same amount as the player.

The player must now decide whether to continue betting or to fold with a "DEAL OR FOLD" message prompting the player. If the player elects to fold, fold button 56 (FIG. 1A) is pushed by the player. All four of the remaining cards of the round are immediately dealt to the player and the opponents, and all cards are turned faceup. The summary hand information (FIG. 11) is given and the winner is identified. If a folding player happened to have the winning hand, such player is rewarded with a fold pot (FIG. 15) which is a fraction of what would have been won if the game had been played to completion.

If a player elects to keep betting and if there are sufficient credits, the bet button 60 (FIG. 1A) or deal button 58 (FIG. 1A) is pushed. If there are insufficient credits for the required bet, "INSERT COIN" is flashed.

The player can elect to push either fold button 56 (FIG. 1A) or deal buttom 58 (FIG. 1A) after each card is dealt, and a message on the screen will prompt him or her.

The player must push deal button 58 (FIG. 1A) to get a faceup, fourth, fifth, and sixth cards with the pot being increased by the player and the opponents each time. A seventh card is dealt faceup to the player and facedown to the opponents if the player again pushes deal button 58 (FIG. 1A).

After all the cards have been dealt, but before the opponents' cards are turned faceup, the player has one more chance to bet. Whether the player pushed the fold button or the deal button, all cards are turned faceup. Summary hand information is displayed and the winner is identified.

If the player has won, a message flashes, "YOU WIN" and the amount of the pot minus the housetake (FIG. 14) is credited to the player to use for future betting. If the player wants to collect the winnings, he or she pushes collect button 66 (FIG. 1A). The coins are then released into a coin outlet 70 (FIG. 1A) for the player to pick up.

If the player has lost the game, the message says, "GAME OVER". Summary hand information is provided with the winner identified, with all hands faceup so the player can see what it took to win.

After the game is over, and the player has sufficient credits to play again, a message prompts the player to "ANTE OR DEAL". If insufficient credits, the message will say "INSERT COIN".

SUMMARY, RAMIFICATIONS, SCOPE

As has been explained, our games provide a tremendous variety of choices: stud poker, hold 'em poker, draw poker and percentage poker games. Not only does the poker player have a choice of games but he or she can also choose various modes, options, number of opponents, housetakes, and bonus payoffs.

All the games are easy to play. No bluffing, calling or raising is allowed. Summary hand information and the automatic bet advance makes the game easy and fast to play. Lots of opponents give the players an opportunity for big bets for big payoffs. Exciting and unusual payoffs are provided: bonus payoffs for the loser, bonus payoffs for the winner, and for additional excitement, a jackpot bonus.

If the player should want company, he or she can play on multiple display devices alongside other players playing percentage poker, all with a different payoff based on the cards for the hand positioned selected.

While the above description contains many specificities, the reader should not construe these as limitations on the scope of the invention, but merely as exemplifications of preferred embodiments thereof.

Those skilled in the art can readily see that this invention can be applied to all poker games, and can envision that many other possible variations are within its scope. Summary hand information can be applied to all poker games. The number of players is limited only by the size of the video screen and the number of car decks used. The cruise control program along with fold tables is needed to determine a reliable payoff for all multiple player poker machines.

Accordingly the reader is requested to determine the scope of the invention by the appended claims and their legal equivalents, and not by the examples which have been given.

We claim:

1. An electronic gaming machine for enabling a player to play a card gambling game in which an imaginary opponent of said player is imitated and simulated, comprising:

(a) a microprocessor control circuit, including a memory, a read-only memory, and a random-access memory for storing a set of playing rules and parameters;

(b) means for enabling said player to cause said machine to simulate one or more imaginary opponents to oppose said player during a round of play;

(c) display means for displaying a plurality of game cards of a player, the same plurality of game cards of said imaginary opponent, and a pot;

(d) means for simulating a deal of a hand of cards to said player and a hand of game cards to said imaginary opponent, and for causing said display means to display said hands of said player and said imaginary opponent, said player's cards being displayed in a faceup manner;

(e) means for enabling said player to ante, bet, and fold on said player's dealt cards;

(f) means for simulating each of said imaginary opponents by causing said display means to display an imitation of the anteing, betting, and folding of said player by each of said imaginary opponents such that said imaginary opponents imitates the actions of said player and so that said player will be able to compete against each of said imaginary opponent;

(g) means for enabling the bets of said player and said imaginary opponent to go into a pot, for continually updating the status of said pot, and for causing said display means to display the status of said pot;

(h) means for calculating a housetake;

(i) winning means for detecting the completion of a round in which a winner is determined, for distributing winnings equal to said pot minus said housetake, and for causing said display means to display an indication of the completion of said round and said winnings; and (j) means for repeatedly activating said means of clauses (b) to (g), supra, until said winning means determines that said round is complete.

2. The machine of claim 1, further including:

(a) means for enabling said player to discard one or more cards from said player's hand;

(b) means for causing one or more of said imaginary opponent's cards to be discarded in response to the discarding of cards by said player; and (c) means for replacing said discarded cards of said player and said imaginary opponent with new cards selected at random.

3. The machine of claim 2, further including:

a poker gameboard which includes spaces that traverse said board, said spaces having representations of cards therein, said board having a display of assigned hand points for a plurality of hand types;

a plurality of markers for indicating a player's progress around said board;

means for assigning a card hand to said imaginary opponent, and for enabling said player to interchange with said imaginary opponent;

means providing a starting space to start said game;

means providing an end space to end said game;

means for enabling said player and said imaginary opponent to play a poker round and for providing a first pot to be distributed after each round;

means providing a second pot which accepts tokens from said participants and for distributing said second pot to a participant that reaches said end space first;

means providing a penalty space for penalizing participants by requiring them to go backward a set amount of spaces upon the occurrence of a perdetermined event;

means providing marker cards and incorporating them as part of a participant's hand;

means providing a plurality of hand points and causing said participants to move a perdetermined number of spaces corresponding to said hand points;

marker means for providing a marker bonus for causing an additional card to be selected at random and dealt to a round winner, and for causing said marker of said round winner to be moved an additional plurality of spaces depending upon the suit or number of said additional card if there are matches with said marker card of said round winner;

means for distributing said second pot to said second pot winner; and means for declaring a board game winner based upon the player or imaginary opponent who holds the largest count of tokens after the distribution of said second pot and the accumulation of said round winnings;

whereby said game machine provides a second pot at the end of said gameboard along with a chance of winning rounds during the poker play of said board game.

4. The machine of claim 2, further including:

(a) means for enabling said player to select a joker for said player to include in said player's hand during a round of play;

(b) means for enabling said player to select a wild card for said player to include in said player's hand during a round of play;

(c) means for enabling said player to select a poker game from the group consisting of stud poker, hold'em poker, draw poker, percentage poker, and percentage draw poker for said player to play during a round of play;

(d) means for enabling said player to select a mode of play from the group consisting of hiball, loball, and hilo for said player to play during a round of play;

(e) means for enabling said player to select an option from the group consisting of standard, faceup, and fastdraw for said player to play during a round of play;

(f) means for enabling said player to select a fixed or a variable housetake during a round of play; and whereby said machine enables a player to be able to play a wide variety of poker games during a round of play.

5. The machine of claim 4 wherein said machine comprises:

a game device containing instruction activators operable by said player with a display panel coupled to said microprocessor control circuit for the display of game symbols, said device including a video terminal, a cathode-ray tube, and a sound generator;

a hard copy output device;

an external storage device; and means for providing a display of visual representatives of said game symbols and causing the display of said visual representatives on said display device, including a display of said cards, tokens, bet, housetake, a jackpot, round winnings, credits, a round winner, conditions of said game, and visual indicators for said instruction activators.

6. The machine of claim 4, further including:

means providing a discard table having a plurality of different discard selection criteria for selecting said cards to be discarded from said hand of said imaginary opponent; and means for analyzing said hand of each of said imaginary opponents using said discard table to determine which of said cards of said hand will be discarded and causing said discard to take place.

7. The machine of claim 4, further including:

means for providing summary hand information which displays a hand rank on or near said hand;

means for providing winning hand information which causes information about the best hand at each stage of said round to be displayed on or near said hand;

whereby said machine will provide a player with fast play with summary hand information.

8. The machine of claim 4, further including:

means providing set ante;

means providing a set bet;

means for causing an automatic advance of a next set ante to said set ante from said credits for said player if sufficient credits exist for said player;

means for causing an automatic advance of a next set bet to said bet from said credits for said player if sufficient credits exist for said player;

whereby said machine will provide a player with fast play with an automatic bet advance.

9. The machine of claim 4, further including:

means providing for statistics to be gathered and organized during all phases of said game, and causing the resultant organized statistical data to be stored in at least one of said memory and said external storage device; and means for printing said organized statistical data and causing said date to be formatted on said display device;

whereby said machine will be able to store, retrieve, and display statistics concerning the operation of said game.

10. The machine of claim 9, further including:

means for providing a cruise-control table for causing said machine automatically to play a plurality of rounds with a set of variables selected from the class consisting of ante and bet values, housetake, and visual display of cards or not; and means for causing said instruction activators to operate for a specified number of rounds and use a set of variables from said cruise-control table to simulate said game actions of said player by transmitting said game actions to said instruction activators.

11. The machine of claim 10, further including:

means providing a fold table, with fold criteria;

means for causing said player to fold when those combinations of cards of said player for a bet do not satisfy the criteria of said fold table;

means providing for statistics to be stored during the operation of said cruise control as affected by said fold table;

means for printing said statistics; and means for displaying said statistics stored during the operation of said cruise control as affected by said fold tables;

whereby said machine will be able to simulate thousands of rounds with an automatic fold mechanism, while providing important statistical capability.

12. The machine of claim 4, further including: means providing a fixed housetake table;

means providing a variable housetake table;

means providing a fold bonus table;

means providing a jackpot bonus table;

means providing a winner bonus table;

means providing a loser bonus table;

means for causing said fixed housetake to be determined when said player makes any selection which requires a fixed housetake;

means for causing said variable housetake to be determined when said player makes any selection which requires said variable housetake by assigning weights from said variable housetake table to a prespecified number of said first-dealt cards of said player for a round, where said number is obtained from said variable housetake table, and computing said variable housetake as sum of said weight percentages;

means for using said fold bonus table to adjust said fold pot according to said hand rank of said folded hand after said hand is dealt to completion;

means for randomizing a variable to provide an eligibility number of rounds in said jackpot bonus table, said eligibility number being in a specified range of allowed numbers;

means for causing the computation of said eligibility number of rounds for said jackpot bonus table after each jackpot bonus is eligible to be paid;

means providing said jackpot bonus when said player is a round winner and when said eligibility number of said rounds has been played after obtaining jackpot bonus eligibility;

means for causing said round winnings either to be increased by said jackpot bonus amount or by adjusting said round winnings using a jackpot bonus factor;

means for using said winner bonus table to adjust said payoff according to said hand rank of said hand of said loser of said round;

whereby said machine will be able to provide a variety of housetake schemes and bonus payoff methods using a jackpot bonus to insure an exciting and varied payoff.

13. The machine of claim 4 , further including:

means providing a variable housetake table;

means for assigning weights from said variable housetake table to prespecified cards for each player and for computing a variable housetake as a combination of said weights;

means for calculating a payoff percentage from said variable housetake;

means for displaying said payoff percentage; and means for computing said winnings using said payoff percentage and the pot or total bet of said player;

whereby said variable housetake creates a new game, called percentage poker and percentage draw poker, where each player receives winnings based on the payoff percentage assigned to said player's hand.

14. The machine of claim 4, further including:

a plurality of display devices, each with a set of instruction activators;

means for displaying said cards on said plurality of display devices;

means for enabling said player to switch with said imaginary opponent so as to make each of said display devices which correspond to said player now correspond to said imaginary opponent and make said display devices which correspond with said imaginary opponent now correspond to said player on said display devices;

means for selecting a hand position on said display device;

means for accepting a unique bet corresponding to said display device; and means for causing each bet made to be independent of the bets on said other display devices;

whereby multiple players can play simultaneously on a card gambling machine with multiple display devices where each player can choose which hand position to bet in an imitative-imaginary opponent game.

15. A poker board game which includes a board with spaces that traverse said baord, with representations of cards inside said spaces, and with a display of assigned hand points for a plurality of hand types, comprising:

(a) a microprocessor control circuit, including a memory, a read-only memory, and a random-access memory for storing a set of playing rules and parameters;

(b) means for enabling said player to cause said machine to simulate one or more imaginary opponents to oppose said player during a round of play;

display means for displaying a plurality of game cards of a player, the same plurality of game cards of said imaginary opponent, and a pot;

means for simulating a deal of a hand of cards to said player and a hand of game cards to said imaginary opponent, and for causing said display means to display said hands of said player and said imaginary opponent, said player's cards being displayed in a faceup manner;

means for enabling said player to ante, bet, and fold on said player's dealt cards;

means for simulating each of said imaginary opponents by causing said display means to display an imitation of the anteing, betting, and folding of said player by each of said imaginary opponents such that said imaginary opponents imitate the actions of said player and so that said player will be able to compete against each of said imaginary opponents;

means for enabling the bets of said player and said imaginary opponent to go into a pot, for continually updating the status of said pot, and for causing said display means to display the status of said pot;

means for calculating a housetake;

winning means for detecting the completion of a round in which a winner is determined, for distributing winnings equal to said pot minus said housetake, and for causing said display means to display an indication of the completion of said round and said winnings;

a plurality of tokens for betting;

a plurality of markers for indicating a participant's progress around said board;

means for enabling a player and imaginary opponent to play and for enabling said player to interchange with said imaginary opponent;

means providing a starting space to start said game;

means providing an end space to end said game;

means for enabling said player and said imaginary opponent to play a poker round and for providing a first pot to be distributed after each round;

means providing a second pot which accepts tokens from said participants and for distributing said second pot to a participant that reaches said end space first;

means providing a penalty space for penalizing participants by requiring them to go backward a set amount of spaces upon the occurrence of a perdetermined event;

means providing marker cards and incorporating them as part of a participant's hand;

means providing a plurality of hand points and causing said participants to move a perdetermined number of spaces corresponding to said hand points;

marker means for providing a marker bonus for causing an additional card to be selected at random and dealt to a round winner, and for causing said marker of said round winner to be moved an additional plurality of spaces depending upon the suit or number of said additional card if there are matches with said marker card of said round winner;

means for distributing said second pot to said second pot winner; and means for declaring a board game winner based upon the player or imaginary opponent who holds the largest count of tokens after the distribution of said second pot and the accumulation of said round winnings;

whereby said board game provides a second pot while combining the excitement of poker and the simplicity and convenience of a board game.

* * * * *